US012698692B2

(12) United States Patent
Thangarajoo et al.

(10) Patent No.: US 12,698,692 B2
(45) Date of Patent: Aug. 4, 2026

(54) DEBRIS PROTECTION AND RETRIEVABILITY SYSTEM FOR BRIDGE PLUGS AND PACKERS

(71) Applicant: Halliburton Energy Services, Inc., Houston, TX (US)

(72) Inventors: Sooriyah Thangarajoo, Singapore (SG); Ashish Khaparde, Singapore (SG); Anthony Phan, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/040,628

(22) Filed: Jan. 29, 2025

(65) Prior Publication Data

US 2026/0218584 A1 Jul. 30, 2026

(51) Int. Cl.
*E21B 33/12* (2006.01)
*E21B 33/128* (2006.01)

(52) U.S. Cl.
CPC ..... *E21B 33/1216* (2013.01); *E21B 33/128* (2013.01)

(58) Field of Classification Search
CPC ..... E21B 33/128; E21B 33/1216
See application file for complete search history.

(56) References Cited

U.S. PATENT DOCUMENTS 4,545,433 A * 10/1985 Wambaugh ..... E21B 33/1216 166/135
4,753,444 A * 6/1988 Jackson ..... E21B 33/1208 277/944
8,276,678 B2 10/2012 Burnett et al.
2007/0144734 A1* 6/2007 Xu ..... E21B 33/1216 166/187
2010/0186970 A1 7/2010 Burnett et al.
2011/0073329 A1* 3/2011 Clemens ..... E21B 23/06 166/134
2017/0058630 A1 3/2017 Limb et al.
2018/0313184 A1* 11/2018 Merron ..... E21B 33/1293
2019/0071948 A1* 3/2019 Phan ..... E21B 33/1216
(Continued)

FOREIGN PATENT DOCUMENTS

WO 2020256730 12/2020

OTHER PUBLICATIONS

"PCT Application No. PCT/US2025/016939 International Search Report and Written Opinion", Oct. 22, 2025, 11 pages.

*Primary Examiner* — David Carroll
(74) *Attorney, Agent, or Firm* — DeLizio, Peacock, Lewin and Guerra, LLP

(57) ABSTRACT

A seal apparatus for use as sealing devices for downhole applications in a wellbore, such as packers and bridge plugs, includes a seal element formed from an elastomeric material. The seal apparatus may include one or more end pieces, referred to as extraction limiting assemblies, which are provided to limit extrusion of the sealing element in direction(s) other than in a radial direction outward from the longitudinal axis of the tool body of the seal apparatus. The end pieces may include components included in a fabric barriers sleeve that encases components of the end caps, the fabric reinforcement barriers allowing for the expansion and contraction of the end caps and the sealing element but limiting or completely blocking debris from entering into any portion of the end caps.

22 Claims, 11 Drawing Sheets

(56) References Cited

U.S. PATENT DOCUMENTS

| | | | | |
|---|---|---|---|---|
| 2019/0100977 | A1* | 4/2019 | Corre | E21B 33/127 |
| 2019/0301263 | A1 | 10/2019 | Atkins et al. | |
| 2021/0164317 | A1* | 6/2021 | Saeed | E21B 33/1216 |

* cited by examiner

DEBRIS PROTECTION AND RETRIEVABILITY SYSTEM FOR BRIDGE PLUGS AND PACKERS

TECHNICAL FIELD

The disclosure generally relates to the field of wellbore operations, and to retrievable bridge plugs and packers for use within a wellbore.

BACKGROUND

Packers and bridge plugs are employed in the operation of wellbore systems to separate and provide fluid seals between various zones and/or sections of annulus and/or tubing present within a wellbore. Various operational versions of packers and bridge plugs may be used. For example, some packers and bridge plugs utilize mechanical compression of a sealing element, such as a rubber seal, to expand the sealing element and thereby form the desired seal between the packer or bridge plug and another surface, such as a surface of a conduit or an inner wall of an open wellbore.

BRIEF DESCRIPTION OF THE DRAWINGS

Embodiments of the disclosure may be better understood by referencing the accompanying drawings. Throughout this disclosure, embodiments as illustrated and described may be referred to as packers and/or as bridge plugs. The systems apparatus, assemblies, methods, and techniques as described herein, and any equivalents thereof, may be included in and/or utilized as part of both packer and bridge plug apparatus.

Figure 1:
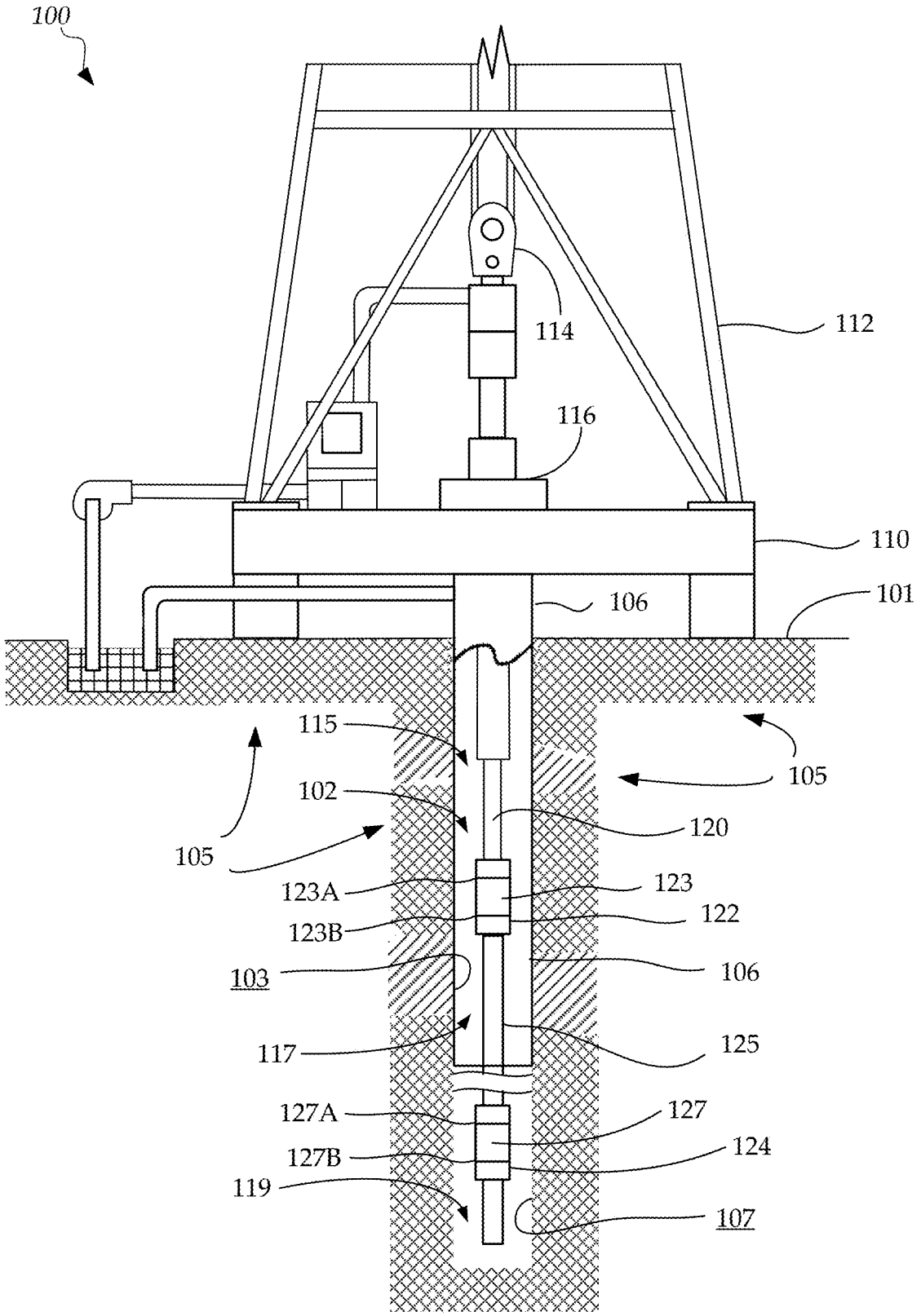
FIG. 1 illustrates a block diagram depicting a wellbore system configured to implement one or more embodiments of the packers or bridge plugs as described herein, and any equivalents thereof.

The drawings are provided for the purpose of illustrating example embodiments. The scope of the claims and of the disclosure are not necessarily limited to the systems, apparatus, methods, or techniques, or any arrangements thereof, as illustrated in these figures. In the drawings and description that follow, like parts are typically marked throughout the specification and drawings with the same or coordinated reference numerals. The drawing figures are not necessarily to scale. Certain features of the invention may be shown to be exaggerated in scale or in somewhat schematic form, and some details of conventional elements may not be shown in the interest of clarity and conciseness.

DETAILED DESCRIPTION

In the following detailed description of the illustrative embodiments, reference is made to the accompanying drawings that form a part hereof. These embodiments are described in sufficient detail to enable those skilled in the art to practice the techniques and methods described herein, and it is understood that other embodiments may be utilized, and that logical structural, mechanical, electrical, and chemical changes may be made without departing from the scope of the disclosure. To avoid detail not necessary to enable those skilled in the art to practice the embodiments described herein, the description may omit certain information known to those skilled in the art. The following detailed description is, therefore, not to be taken in a limiting sense.

The embodiments described herein relate to systems, apparatus, assemblies, methods, and techniques that may be associated with seal apparatus designed for use downhole in a wellbore. The seal apparatus may be associated with packer and/or bridge plugs configured for use in providing seals between various areas of an annulus and/or zones within a conduit or tubing when deployed and actuated downhole in a wellbore environment. In various operations, as opposed to being intended as a permanently required seal, the embodiments of the seal apparatus as described herein may be configured to be de-actuated to unseal and to be retrieved from and/or repositioned within the wellbore.

The retrievability of tools such as packers and bridge plugs are critical for operations in an oil and gas well. During operation the elastomer material forming the sealing element of a packer or bridge plug can become deformed via extrusion or damage. During later retrieval of the tool comprising the sealing element, if the entire sealing package (including the elastomer and the backup system) is unable to relax enough to be pulled through restrictions in the tubing string or other conduits in the wellbore, the result may be lost time and added cost spent to retrieve the sealing assembly. Embodiments of the seal apparatus and assemblies as described herein improve the retrievability of packers and bridge plugs using a system of improvements that can be implemented individually or as a combination of improvements used in conjunction with each other.

For example, in various versions of existing seal apparatus, an expandable metal ring with slots cut into it and wedge segments that move radially outwardly to maintain a continuous surface abutting the respective end of the sealing element may be employed. The expandable metal ring provides support to the elastomeric sealing element utilized to form the desired seal, and prevents extrusion of the sealing element through the expandable metal ring through the use of the wedge segments. However, the existing versions of the expandable metal ring does not address the migration of debris in the well fluid into the slots of the metal ring from the side away from the sealing element and the segmented wedges, which are still exposed to the well fluid. This debris, when caught in between the slots, may prevent the expandable metal ring from retracting completely when attempting to deactivate the seal apparatus for the purpose of retrieving the packer or the bridge plug from the wellbore, or when attempting to relocate the sealing element within the wellbore. In wellbore tools such as retrievable packers or bridge plugs where the retrievability of the tool through tight restrictions are critical, this will be a disadvantage. In addition, the wedge segments used in conjunction with the expandable metal rings are also designed to move radially outward to create a continuous seal in a fixed inner diameter. Any variances in the casing inner diameter will result in the wedges not being completely aligned and having small gaps in every alternate segment that will lead to sealing element extrusions through those gaps.

Embodiments of the seal apparatus as described herein provide devices, assemblies, and techniques to obviate or mitigate one or more of these disadvantages related to existing seal apparatus, and to provide improvements to seal apparatus that enhance the retrievability of the seal apparatus after use within a wellbore environment. Embodiments of the seal apparatus as described herein provide comprehensive solutions configured to enhance and address the issues of debris protection, prevention of elastomer extrusion, and improvement of the reliability of retrievable tools such as packers and bridge plugs. As such, embodiments of the seal apparatus as described herein provide an improvement to the field of wellbore seal apparatus technology.

Embodiments to the seal apparatus as described herein include one, some combination of, or all of the following features:

Rubber-Infused Fabric Barrier: Embodiments include a fabric barrier infused with rubber that encases the expandable metal ring assembly included as part of a seal apparatus. The fabric barrier expands and contracts with the movement of the expandable metal rings, effectively preventing debris from entering the slots or other opening incorporated into the expandable metal ring during downhole operations. The use of the fabric barrier enhances the retractability of the expandable metal ring and also the wedge segments used in conjunction with the expandable metal rings, while also filling small gaps created by the segmented wedges, thus preventing rubber extrusion through these gaps. In various embodiments, the fabric material is woven carbon fiber. However, selection can be made from a wide variety of material options based on the application. The fabric can be rubber infused where rubber material is layered over the fabric and bonded together. This will further strengthen the fabric reinforcement.

Molded Fabric Barrier on Elastomer: Another component that may be incorporated into the seal apparatus as disclosed herein is a fabric barrier molded onto the end of the sealing element that contacts the expandable metal rings and wedges forming the anti-extrusion system. The use of the fabric barrier incorporated into the sealing element improves the retrievability tool that includes the sealing element having the molded fabric barrier. In addition, the molded fabric barrier acts as a secondary extrusion barrier, working in tandem with the fabric barrier that encases the expandable metal ring, in order to mitigate extrusion of the sealing element when actuated to form a seal and pressure is applied from either end.

Retrieval Reinforcement Assembly: Another component that may be utilized as part of the seal apparatus as described herein includes a metal reinforcement "cage" or "basket" comprising an arrangement of rings and wires embedded axially and arranged circumferentially within the proximal end of the sealing element of a seal apparatus. Acting in a manner analogous to rebar in concrete, these rings and wires hold the proximal portions of the sealing element physically together during retrieval of the sealing assembly from the wellbore, even if there are complete tears in the elastomeric material forming the sealing element. In particular, when used in combination with the molded fabric barrier as described in the paragraph above, this setup of a seal apparatus creates a highly reliable retrieval system, ensuring that the sealing element remains intact during a retrieval process that may be performed on the sealing assembly.

Alternate Debris Barrier: Another component that may be utilized as part of the seal apparatus as disclosed herein includes an expandable elastic ring positioned behind the expandable metal ring. In various embodiments, the expandable elastic ring is configured to expand over a wedge or set of wedge shaped setting blocks, causing the expandable elastic ring to expand radially outward from the tool body of the seal apparatus and to eventually contact the inner surface of the casing or other tubing, thereby acting as a debris barrier, which prevents debris from reaching the expandable metal ring and the wedges used as part of the extrusion limitation apparatus associated with the seal apparatus.

Together and/or individually, the above described components offer cost effective and robust solutions for improving overall tool reliability with regards to seal apparatus, and the retrievability of seal apparatus configured for use in wellbore environments.

As utilized throughout this disclosure, and unless otherwise described herein, the term "inner surface" refers to a surface or surfaces of a device or an entity that is/are closest in a radial direction to the longitudinal axis of the packer or bridge plug relative to other parts or portions of the device or entity, and the term "outer surface" refers to a surface or surfaces of a device or an entity that is/are farthest in a radial distance from the longitudinal axis of the packer or bridge plug relative to other parts or portions of the device or entity. Wellbore system that may utilize one or more embodiments of the seal apparatus as disclosed herein, or any equivalents thereof, are illustrated and further described below with respect to FIG. 1.

Additional details regarding embodiments of the seal apparatus as disclosed herein are illustrated and further described below with respect to FIGS. 2, 3A-3B, 4A-4D, 5, 6A-6B, and 7. Various methods for operating a wellbore system utilizing the seal apparatus as disclosed herein, and any equivalents thereof, are illustrated and further described below with respect to FIG. 8. It would be understood that embodiments of this disclosure may be practiced without all of the specific details as described herein. Further, while the wellbores as illustrated and described in the figures of this disclosure are shown as comprising a vertically oriented borehole, embodiments of wellbores where the systems and methods as described in this disclosure may be deployed are not limited to wellbores having any particular orientation, and may include vertical, horizontal, and/or inclined wellbores, and combinations of these, including wellbore systems including one or more branches coupled to a main, a secondary, or other network(s) of a wellbore.

Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of the well, regardless of the wellbore orientation. Use of any one or more of the foregoing terms shall not be construed as limited to denoting positions along a perfectly vertical axis. In some instances, a part near the end of the well can be horizontal or even slightly directed upwards. Unless otherwise specified, use of the term "subterranean formation" shall be construed as encompassing both areas below exposed earth and areas below earth covered by water, such as an ocean, or a body of fresh water.

Throughout this disclosure the terms "proximal" and "distal" are used to refer to a particular end portion of a device or element, such as a tubing or a borehole, which extend for some distance in a colinear or parallel direction relative to a longitudinal axis of the wellbore. The term "proximal" or "proximal end" refers to the end portion of the device or element that is closest to the wellhead of a wellbore when measured along the longitudinal axis of the wellbore and regardless of the actual distance from the wellhead. The term "distal" or "distal end" refers to the end portion of the device or element that is closest to the terminal end of a wellbore when measured along the longitudinal axis of the wellbore and regardless of the actual distance from the terminal end of the wellbore.

FIG. 1 illustrates a block diagram depicting a wellbore system 100 configured to implement one or more embodiments of the packers or bridge plugs as described herein, and any equivalents thereof. As shown in FIG. 1, wellbore system 100 ("system 100") includes a wellbore 102 extending below surface 101 and into a formation 105. A platform 110 supports a derrick 112 over the area of the wellbore 102, the derrick configured with a hoist 114 to control the raising and lowering of various conduits, such as conduit 120, which may be coupled to one or more packers or one or more bridge plugs (hereinafter "packers") 122, 124, through an opening in platform 110 leading into wellbore 102. The opening in platform 110 may include a turntable or anchor collar 116, configured to stabilize the conduits and tooling being raised and lowered within the wellbore by hoist 114.

The space between platform 110 and surface 101 may include a casing 106, which extends below surface 101 and to some depth within the wellbore 102. A packer 122 may be coupled to a conduit 120 that is suspended within the casing 106 of the wellbore 102. The packer 122 as shown in FIG. 1 is in an unactuated configuration, such that the sealing element 123 of the packer has not yet compressed to extend the sealing element radially outward to contact the casing 106. Once positioned in the desired location within the casing 106, packer 122 may be actuated by compressing the sealing element longitudinally, which in turn causes the sealing element 123 of the packer to expand until one or more surfaces of the sealing element come into sealing contact with the inner surface 103 of the casing 106. When the sealing element 123 is compressed to form a seal between the packer 122 and the inner surface 103 of wellbore 102, the packer 122 is considered to be in an actuated configuration, and provides a fluid seal between the upper cased annulus area 115 and the lower annulus area 117 of the wellbore 102.

In various embodiments, packer 122 further includes a proximal support apparatus 123A, and in various embodiments also includes a distal support apparatus 123B. Devices that may be included in the proximal support apparatus 123A in some instances are positioned proximally adjacent to sealing element 123, may overlap with and/or may be fused to or embedded within the sealing element 123. Certain devices included in proximal support apparatus 123A are configured to expand radially when the sealing element 123 is being expanded, the proximal support apparatus configured to provide a physical barrier that limits or prevents completely the extrusion of the sealing element in a proximal direction past the proximal support apparatus, even when the sealing element 123 has been fully actuated to contact the inner surface 103 of the wellbore.

Figure 2:
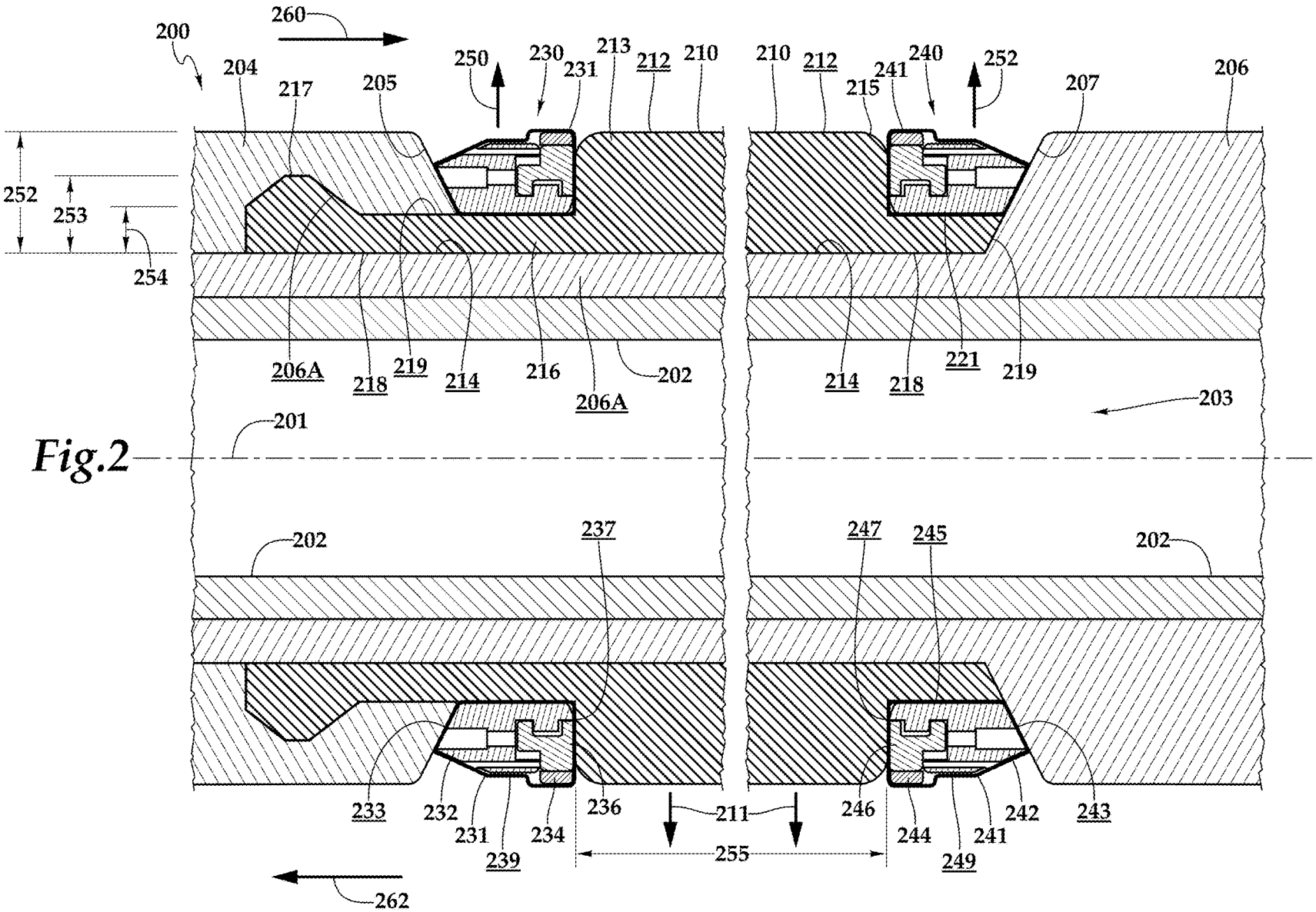
FIG. 2 illustrates a cross-sectional view of a seal apparatus, in accordance with various embodiments.

Embodiments of the proximal support apparatus 123A include a fabric barrier sleeve (now shown in FIG. 1, but see fabric barrier sleeve 231, FIG. 2). The fabric barrier sleeve encloses one or more of the devices forming the proximal support apparatus, the fabric barrier sleeve configured to prevent debris that may be present in the wellbore from entering into and/clogging the spaces provided as part of the proximal support apparatus that allow the proximal support apparatus to expand in a radial manner when the sealing element 123 is being expanded. Debris may be present in wellbore 102 due to drilling operations and/or other well treatment operations that are or have previously been performed on the wellbore, and may include formation material and/or other types of debris introduced from the surface into the wellbore. By preventing debris from entering and/or clogging the openings of the proximal support apparatus 123A while the packer 122 is acting as a seal within the wellbore, the proximal support apparatus is better capable of contracting back toward its original outer diameter when the packer is being de-actuated for the purpose of removal of packer 122 from the wellbore and/or simply to remove the seal between annulus area 115 and annulus area 117 within the wellbore 102.

Embodiments of packer 122 may also include a fabric layer (not shown in FIG. 1, but see fabric reinforcement layer 740, FIG. 7), which may be bonded onto some portion of the sealing element 123. The fabric layer acts as a high density net that aids in keeping the sealing element in place, and assists in keeping the material, such as wellbore debris, off the sealing element, in particular the sealing element and the extraction pull tab of the sealing element, intact during a retrieval of the packer 122 from the wellbore 102.

Figure 5:
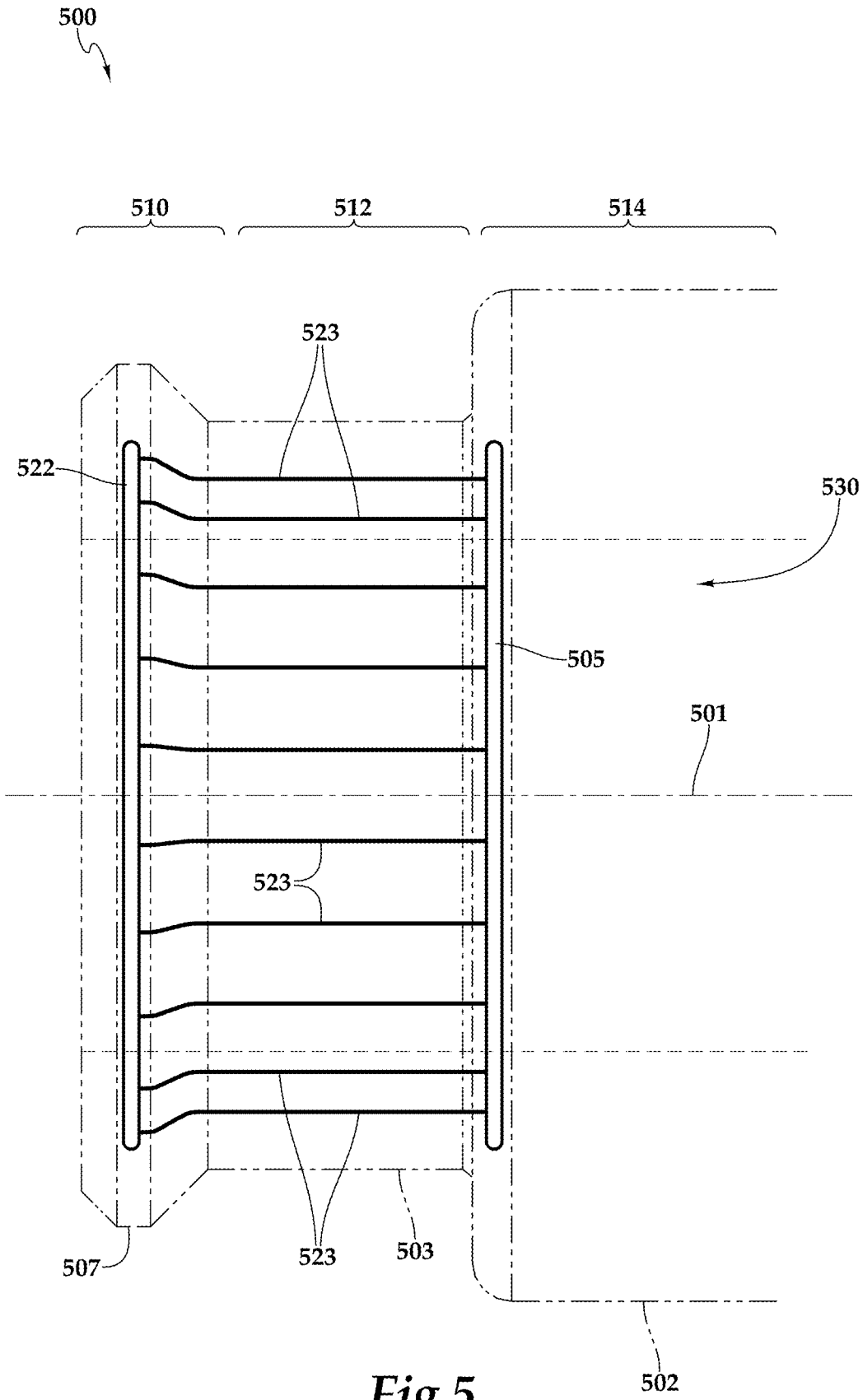
FIG. 5 illustrates a side partial view of a portion of a sealing element including a wire reinforcement structure 520, in accordance with various embodiments.

In various embodiments, a wire reinforcement structure is embedded into the sealing element 123 (not shown in FIG. 1, but see wire reinforcement structure 520, FIG. 5). Portions of the wire reinforcement structure include a wire ring embedded within the pull tab portion of the sealing element, coupled to a second wire ring embedded in the main body of the sealing element by a plurality of individual wires arranged radially around the inner circumference of the sealing element. The wire reinforcement structure is configured to provide additional pulling strength to the sealing element 123 as force is applied to the pulling tap portion of the sealing element 123 as part of an extraction process being performed on the packer 122.

Figure 6A:
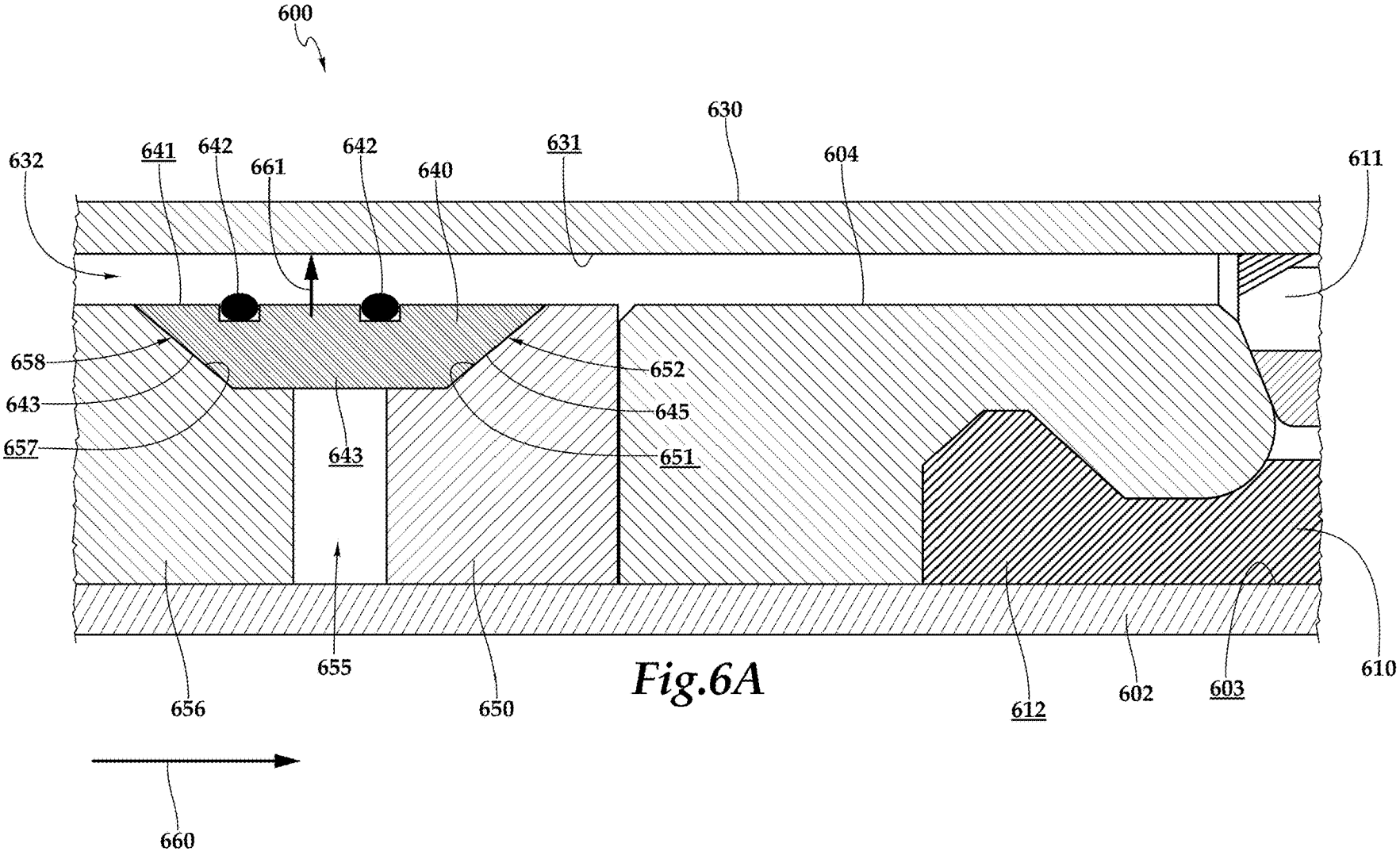
FIG. 6A illustrates a seal apparatus including a seal debris barrier in an unactuated configuration, in accordance with various embodiments.
Figure 6B:
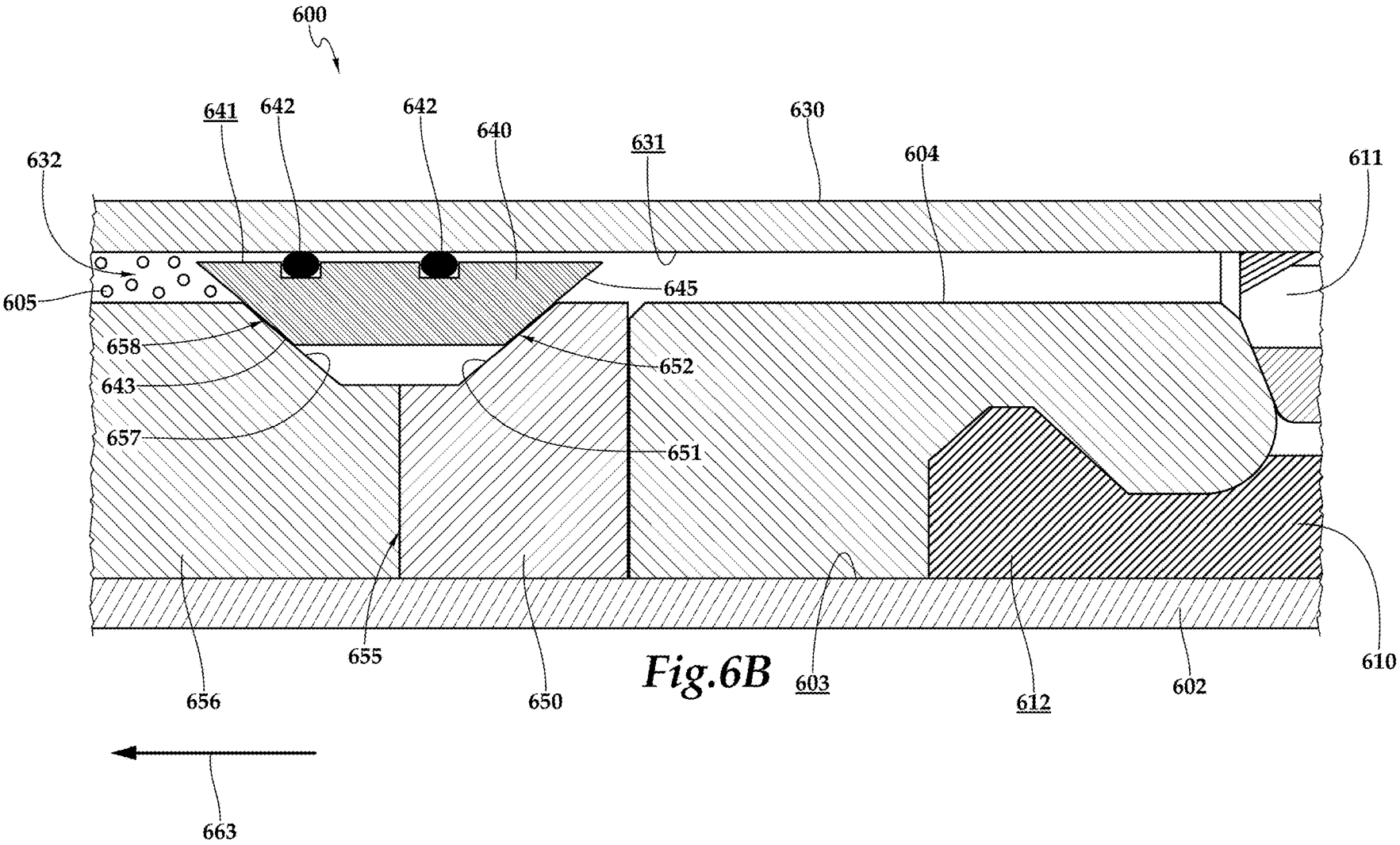
FIG. 6B illustrates the seal apparatus of FIG. 6A including debris barrier in an actuated configuration, in accordance with various embodiments.

Embodiments of packer 122 may include a debris barrier positioned proximally of the packer (not shown in FIG. 1, but see debris barrier 640, FIGS. 6A-6B). The debris barrier is configured to be actuated radially and to provide a barrier to debris that may be present in annulus area 115, preventing the debris from coming into contact with the proximal support apparatus 123A and/or the sealing element 123 of the packer 122.

In various embodiments, packer 122 includes a distal support apparatus 123B. Distal support apparatus 123B may be configured as a mirror image arrangement any combination of the components described above with respect to proximal support apparatus 123A, but position at the distal end of packer 122, and configured to provide any of the features ascribed to the proximal support apparatus 123A based on the components included in the particular version of the distal support apparatus provided as part of packer 122.

As shown in FIG. 1 system 100 may further include packer 124. Packer 124 may be coupled to and positioned within wellbore 102 by conduit 125, and includes a sealing element 127 configured to form a seal, when packer 124 is actuated to an actuated configuration, with the inner surface 107 of an open portion 119 of wellbore 102. Packer 124 may include a proximal support apparatus 127A. Proximal support apparatus 127A may include any of the devices and apparatus, and may be configured to provide any of the features ascribed to proximal support apparatus 123A, but with respect to packer 124. Further, embodiments of packer 124 may include distal support apparatus 127B. Distal support apparatus 127B may include any of the devices and apparatus, and may be configured to provide any of the features ascribed to distal support apparatus 123B, but with respect to packer 124.

The various individual features, and/or combination(s) thereof, of the embodiments described above with respect to packer 122 and packer 124 allow for improved deactuation of the sealing elements, and improved retrievability of these packer from the wellbore, by providing debris protection, improved construction characteristics of the extrusion limitation properties, and added strength characteristics to the sealing elements of the packer.

Although shown in FIG. 1 as comprising a strictly vertical wellbore 102, embodiments of system 100 may include packers and/or bridge plugs that are located and configured to form seals in portions of wellbores that have other than vertical orientations, and may include the use of the seal apparatus as described herein, and any equivalents thereof, in non-vertical wellbores having horizontal and/or other longitudinal directions relative to the vertical orientation shown in FIG. 1. In addition, as shown in FIG. 1 system 100 is illustrated as a terrestrial based system, but system 100 may include a wellbore system that extends through a body of water, such as a lake or an ocean, for some portion of the cased wellbore system.

FIG. 2 illustrates a cross-sectional view of a seal apparatus 200, in accordance with various embodiments. In various embodiments, seal apparatus 200 is configured to operate as a retrievable packer or a retrievable bridge plug, such as packer 122 of system 100 (FIG. 1), which may be positioned within another conduit, such as a wellbore casing or a section of production tubing (not shown in FIG. 2, but see casing 106, FIG. 1). In various embodiments, seal apparatus 200 of FIG. 2 may be configured to operate as a retrievable packer configured to provide a seal in an open hole portion of a wellbore, such as packer 124 as illustrated and described above with respect to system 100 and FIG. 1.

As shown in FIG. 2, seal apparatus 200 includes a tool body 202 having a tubular shape that may be circular in cross-section, and that encircles longitudinal axis 201 to partially enclose the internal space 203. In various embodiments, tool body 202 is configured to be coupled to additional sections of conduit, tubing and/or other downhole tools (not shown in FIG. 2, but see conduit 120, conduit 125, system 100, FIG. 1), and further configured so that internal space 203 forms a fluid passageway to allow for the flow of fluid through the seal apparatus 200 using the fluid passageway. In other embodiments, internal space 203 may be blocked at some point along the internal space to prevent the flow of any fluids through the internal space 203 of the seal apparatus 200.

As further shown in FIG. 2, seal apparatus 200 includes sealing element 210 that encircles the tool body 202 for some length longitudinally along the tool body, and is positioned on and between portions of a movable seal block 204 and a stationary seal block 206, as further described below. Sealing element 210 includes a bottom surface 214 that extends along and is in contact with of a narrowed portion 206A of the stationary seal block 206, and completely encircles radially the outer surface 218 of the narrowed portion 206A for some length along longitudinal axis 201. Sealing element 210 includes an outer surface 212 positioned opposite of the bottom surface 214, the outer surface 212 completely encircling radially some portion of the sealing element 210 for a longitudinal length relative to longitudinal axis 201. The outer surface 212 of sealing element 210 is configured to be expanded in an outward direction radially, as illustratively indicated by arrows 211, when the seal apparatus 200 is actuated, as further described below, in order to allow outer surface 212 to come into contact with a surface positioned adjacent to the seal apparatus, such as a wellbore conduit or the inner surface of an open hole portion of a wellbore, and thereby form a seal between the tool body 202 of the seal apparatus and the adjacent surface brought into contact with outer surface 212.

Sealing element 210 includes a thickness dimension having a height 252 extending from bottom surface 214 to outer surface 212 along the portions of the sealing element over which the outer surface 212 extends. Sealing element 210 further includes a proximal narrowed portion 216 of the sealing element that extends proximally from a proximal end 213 of the portion of the sealing element that includes the outer surface 212. The proximal narrowed portion 216 extends in a proximal direction away from the main body of the sealing element 210, extending over a longitudinal length while encircling and in contact with the outer surface 218 of the narrow portion 206A of the stationary seal block 206. At the proximal end of the proximal narrowed portion 216, the sealing element 210 includes a pull ridge 217. Pull ridge 217 encircles a portion of the outer surface 218 of the narrowed portion 206A of the stationary seal block 206, and extends radially away from the outer surface 218, the pulling ridge having a thickness dimension 253 that is larger than the thickness dimension 254 for the proximal narrowed portion 216 of the sealing element 210. The pull ridge 217 is configured to engage a notch 204A formed along a radially inward facing surface of movable seal block 204, wherein notch 204A is configured to have a recessed shape that conforms to and is in contact with the outward facing surfaces of pull ridge 217. Movable seal block 204 includes a portion of the block that extends along a proximally facing portion of the pull ridge 217 and extends proximally of pull ridge 217 to include a surface of the movable seal block that is in direct contact with the outer surface 218 of the proximally extending narrowed portion 206A of movable seal block 204.

Movable seal block 204 includes a distal portion of the movable seal block that extends over and encircles pull ridge 217 and a proximal portion of the proximal narrowed portion 216 of the sealing element 210. A distally facing surface 205 of the movable seal block 204 is spaced some distance proximally of the proximal end 213 of the main body of the sealing element 210, thereby creating a recessed area between the movable seal block 204 and the main body of the sealing element 210 where an extrusion limitation assembly 230, (hereinafter "assembly 230"), is located.

As shown in FIG. 2, assembly 230 includes a metal expansion ring 232 coupled with an extrusion limitation ring comprising set of outer wedges 234 positioned in an alternating circular arrangement with a set of inner wedges 236. The metal expansion ring 232, along with the inner wedges 236 and the outer wedges 234, completely encircle the proximal narrowed portion 216 of sealing element 210, and are themselves completely enclosed within fabric barrier sleeve 231, which also completely encircles the proximal narrowed portion 216 of sealing element 210. When in the unactuated configuration as shown in FIG. 2: proximally facing surface 233 of assembly 230 faces and is in contact with the distally facing surface 205 of the movable seal block 204; an inward facing surface 235 of assembly 230 faces and is in contact with an outer surface 219 of the proximal narrowed portion 216 of the sealing element 210; a distally facing surface 237 of assembly 230 faces and is in physical contact with the a surface of the proximal end 213 of sealing element 210; and a top surface 239 of assembly 230 faces radially outward from tool body 202, and is not in direct contact with any other surfaces of seal apparatus 200. As further described below, when seal apparatus 200 is actuated to form a seal, movable seal block 204 is urged to move in a distal direction laterally, as illustratively represented by arrow 260, thereby compressing at least the main body 255 of the sealing element, and also causing assembly 230 to expand radially outward, as illustratively represented by arrow 250. When expanded, assembly 230 provides support to the main body 255 of the sealing element to limit or completely prevent proximal extrusion of the main body of the sealing element, while also maintaining enclosure of the assembly 230 with the fabric barrier sleeve 231. The fabric barrier sleeve 231 expands with the expansion of assembly 230 to maintain enclosure of the components of the assembly, and thereby prevents debris from clogging the slots, spaces, and gaps that may be present within the metal expansion ring 232 and wedges 234, 236 due to the expansion of assembly 230. By maintaining the enclosure of the assembly 230 using fabric barrier sleeve 231, the fabric barrier sleeve contributes to the capability of assembly 230 to contract back to the dimensions of the assembly 230 prior to the expansion at some point in time when the seal apparatus 200 is intentionally being de-actuated for example for the purpose of retrieval of the seal apparatus from the wellbore.

In addition to or in the alternative, embodiments of assembly 230 may incorporate one or more addition features, including a wire reinforcement structure embedded in the sealing element, a debris barrier positioned proximally of the assembly 230, and/or a fabric reinforcement layer fused onto some portion of an outer surface or surfaces of the sealing element. Combinations of these features may be incorporated into seal apparatus 200 in order to enhance debris protection and retrievability of the sealing assembly during installation, use, and removal of the seal apparatus as part of one or more wellbore operations.

As further shown in FIG. 2, embodiments of seal apparatus 200 include a distally positioned extrusion limitation assembly 240, (hereinafter "assembly 240"). Assembly 240 may be configured as a mirror image of assembly 230, but positioned to encircle a distally extending portion 223 of sealing element 210, and positioned in a recess extending between the distal end 215 of the main body 255 of the sealing element and a proximally facing surface 207 of stationary seal block 206. Assembly 240 includes an arrangement of components that correspond to the components included in assembly 230, but arranged in a mirror image or reverse manner longitudinally. As shown in FIG. 2, assembly 240 includes metal expansion ring 242 coupled to outer wedges 244 and inner wedges 246, all of which are enclosed in fabric barrier sleeve 241.

When in the unactuated configuration as shown in FIG. 2: distally facing surface 243 of assembly 240 faces and is in contact with the proximally facing surface 207 of stationary seal block 206; inward facing surface 245 of assembly 240 faces and is in contact with an outer surface 221 of the distally extending portion 223 of the sealing element 210; proximally facing surface 247 of assembly 240 faces and is in physical contact with the a surface of the distal end 215 of sealing element 210; and a top surface 249 of assembly 240 faces radially outward from tool body 202, and is not in direct contact with any other surfaces of seal apparatus 200. As further described below, when seal apparatus 200 is actuated to form a seal, the lateral compression of the main body 255 of the sealing element 210 creates a lateral force on assembly 240, which due to the positioning of assembly 240 adjacent to stationary seal block 206, causes assembly 240 to expand radially outward, as illustratively represented by arrow 256 as the outer surface 212 of the sealing element is also expended radially outward. When expanded, assembly 240 provides support to the main body 255 of the sealing element to limit or completely prevent any distal extrusion of the main body of the sealing element, while also maintaining enclosure of the assembly 240 within the fabric barrier sleeve 241. The fabric barrier sleeve 241 prevents debris from clogging the slots, spaces, and gaps that may be present within the metal expansion ring 242 and wedges 244, 246 due to the expand of assembly 240, and contributes to the capability of assembly 240 to contract back to the dimensions of the assembly 240 prior to the expansion.

In addition to or in the alternative, embodiments of assembly 240 may incorporate one or more addition features including wire reinforcement structure embedded in the sealing element, a debris barrier positioned distally of the assembly 240, and/or a fabric reinforcement layer fused onto some portion of an outer surface or surfaces of the sealing element 210. Combinations of these features may be incorporated into seal apparatus 200 in order to enhance debris protection and retrievability of the sealing assembly during installation, use, and removal of the seal apparatus as part of one or more wellbore operations.

In operation, seal apparatus 200 is positioned downhole and adjacent to the inner surface of another conduit or tubing, or the inner surface of an open hole portion of a wellbore, where the sealing element is to be actuated to form a seal. Actuation of the seal apparatus 200 may be initiated by moving the movable seal block 204 in a distal direction, as illustratively represented by arrow 260, while the position of stationary seal block 206 remain fixed relative to the longitudinal position along tool body 202. The distal movement of movable seal block 204, in conjunction with the fixed positioning of stationary seal block 206, results in a lateral compression force being applied to seal element 210. As a result of the lateral compression force, outer surface 212 of the seal element 210 is urged radially outward in a direction illustratively represented by arrows 211 until the outer surface 212 makes sealing contact with the inner surface that is positioned adjacent to the sealing assembly, thereby forming a seal between the tool body 202 and the adjacent inner surface.

As part of the actuation process, the distally facing surface 205 of the movable seal block 204 making contact with the sloped proximally facing surface 233 of assembly 230 causes the assembly 230 to expand radially outward when maintaining the inward facing surface 235 of assembly 230 in physical contact with the outer surface 219 of the proximal narrowed portion 216 of the sealing element. The outward expansion of assembly 230 allows the distally facing surface 237 of assembly 230 to maintain contact with the proximal end 213 of sealing element 210 even as the sealing element 210 expands radially outward, thereby limiting or completely preventing extrusion of the proximal end of the sealing element in a proximal direction toward the movable seal block 204. As part of the expansion of assembly 230, fabric barrier sleeve 231 also expands to maintain complete enclosure of the extrusion limiting mechanisms provided by metal expansion ring 232, and wedges 234, and 236. As a result, when seal apparatus 200 has been fully actuated, and the sealing element 210 is fully expanded to make contact with and form the desired seal with the adjacent surface, fabric barrier sleeve 231 maintains a covering layer over any expansion slots, fastener opening, and gaps that may be present within and that allows for the radial expansion of assembly 230. Fabric barrier sleeve 231 thereby prevents particles and debris that may be present in the portion of the annulus proximal to assembly 230 where the seal has been formed from entering into and clogging the expansion slots, fastener openings, and gaps that may be present within the assembly 230.

Also, as part of the actuation process the slope of the proximally facing surface 207 of the stationary sealing block 206 making contact with the sloped distally facing surface 243 of assembly 240 causes the assembly 240 to expand radially outward while maintaining contact with the outer surface 221 of the distally extending portion 223 of the sealing element 210. The outward expansion of assembly 240 allows the proximally facing surface 247 of assembly 240 to maintain contact with the distal end 215 of sealing element 210 even as the sealing element 210 expands radially outward, thereby limiting or completely preventing extrusion of the distal end 215 of the sealing element 210 in a distal direction toward the stationary seal block 206. As part of the expansion of assembly 240, fabric barrier sleeve 241 also expands to maintain complete enclosure of the components, including metal expansion ring 242 and wedges 244 and 246, provided as part of the assembly. As a result, when seal assembly 200 has been fully actuated, and the sealing element 210 is fully expanded to make contact with and form the desired seal with an adjacent surface, fabric barrier sleeve 241 maintains a covering layer over any expansion slots, fastener opening, and gaps that may be present within the assembly 240 that allow for the expansion of assembly 240. Fabric barrier sleeve 241 thereby prevents particles and debris that may be present in the portion of the annulus distally located relative to the sealing assembly where the seal has been formed from entering into and clogging the expansion slots, fastener opening, ang gaps that may be present within the assembly 240.

At some point in time, it may be desirable and/or necessary to de-actuate the sealing element 210 back to a non-actuated configuration in order to release the sealing element and to retrieve the seal apparatus, for example, from within a conduit or tubing where the seal apparatus 200 is positioned, or from within an open borehole portion of a wellbore. In various embodiments, deactuation of the seal apparatus 200 may be initiated by moving the movable sealing block 204 in a proximal direction longitudinally, for example in a direction illustratively represented by arrow 262. During the movement of the movable seal block 204 in the proximal direction, pull ridge 217 of the sealing element 210 remains engaged with the notch 204A. As such, the proximal movement of the movable seal block 204 results in drawing the pull ridge 217 in a proximal direction, and thereby drawing in the proximal direction the proximal narrowed portion 216 and the proximal end 213 of the sealing element 210. The resulting movement of these portions of the sealing element 210 causes a longitudinal stretching of the sealing element, resulting in the outer surface 212 of the sealing element to be retract radially inward, and to move away from being in contact with the inner surface of an adjacent conduit, tubing, or wellbore surface that the sealing element had previous been actuated to seal against.

As the movable seal block 204 is drawn in the proximal direction and the sealing element 210 is being stretched, the spring like characteristic of metal expansion ring 232 of the assembly 230 will also be urged into a smaller overall outer circumference while allowing the proximal end 213 of sealing element to extend proximal, and thereby allow outer surface 212 to retract inward in a radial direction. In a similar manner, the spring like characteristic of metal expansion ring 242 of assembly 240 will also be urged into a smaller overall outer diameter while allowing the distal end 215 of the main body 255 of the sealing element 210 to return to a non-actuated configuration. The stretching of the sealing element 210, along with the retraction of the overall outer circumferences of the assemblies 230 and 240, allow these part of the seal apparatus to return to a position wherein all outer surfaces of the seal apparatus extend to a height dimension no higher than height 252, which is at or below the original height of the sealing element 210 and the assemblies 230 and 240 prior to the actuation of the seal assembly. The capability of the assemblies 230 and 240 to contract to or nearly to their respective pre-actuation dimensional configuration is aided by the use of the fabric barrier sleeves 231 and 241 at least due to the fabric barrier sleeves having prevented the slots, apertures, and gaps present within these assemblies from becoming clogged with debris, which would otherwise inhibit the radial contraction of the assemblies into a more compact shape during deactuation of the seal assembly. In addition, the elastic properties of the fabric barrier sleeves 231 may also assist in urging the contraction of the assemblies 230 and 240 during the deactuation process due to the elastomeric property of the sleeves themselves.

In various embodiments, the sealing element 210 may be formed from an elastomeric material, such as but not limited to rubber or a compound of rubber. The fabric barrier sleeve may be formed from a fabric or woven material, which is infused and/or coated with an elastic material, such as rubber. The overall construction and material used to form the fabric barrier sleeves 231, 241 provide the sleeves with elasticity and dimensionally stretchable and reconformable characteristics. Additional devices, such as the tool body, seal blocks, metal expansion rings, and wedges, which may be included in the seal apparatus 200, may be formed from metal or a metal alloy, such as but not limited to steel.

Figure 3A:
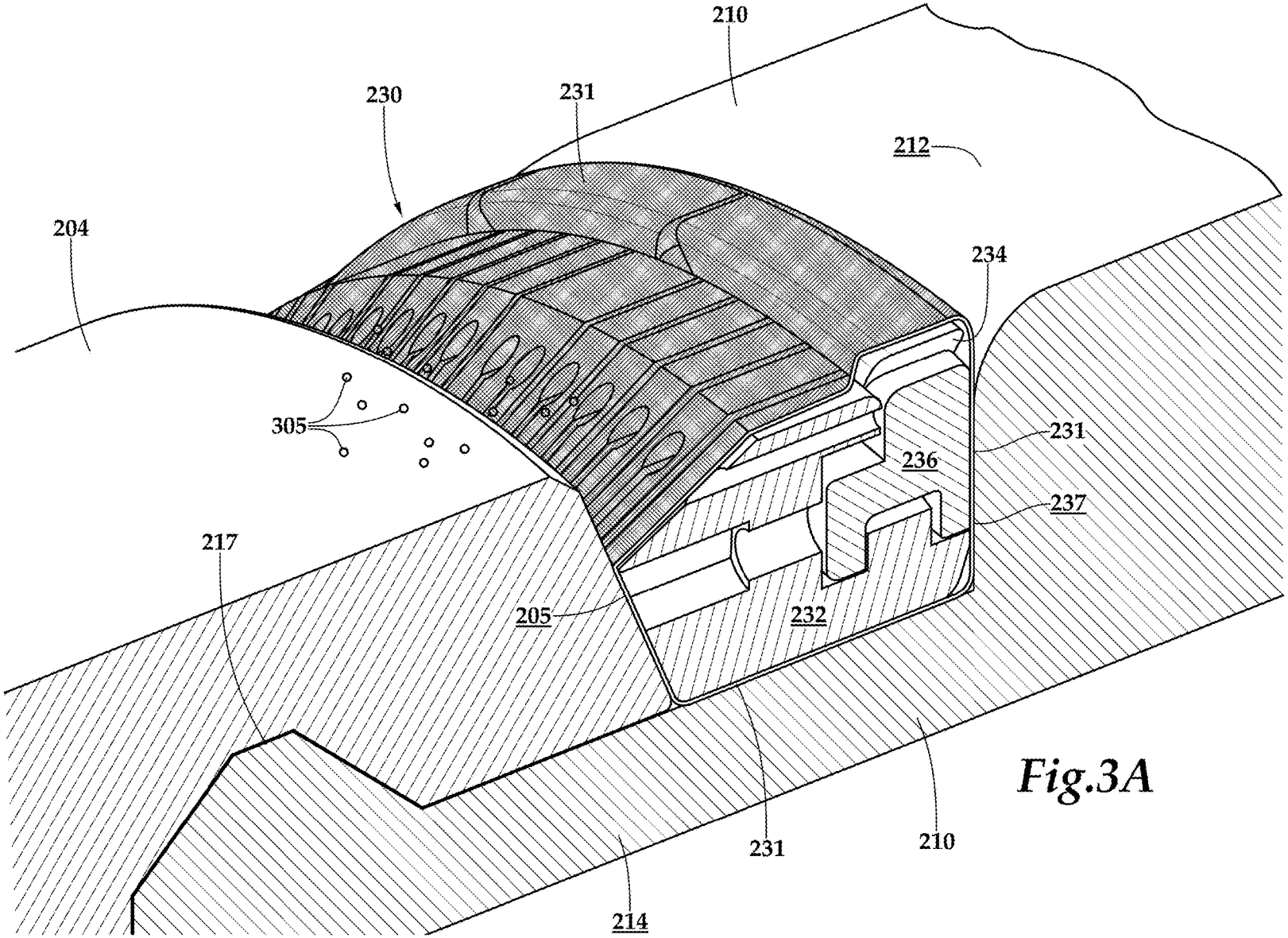
FIGS. 3A-3B illustrate perspective views of a proximal portion of the seal apparatus of FIG. 2, in accordance with various embodiments.
Figure 3B:
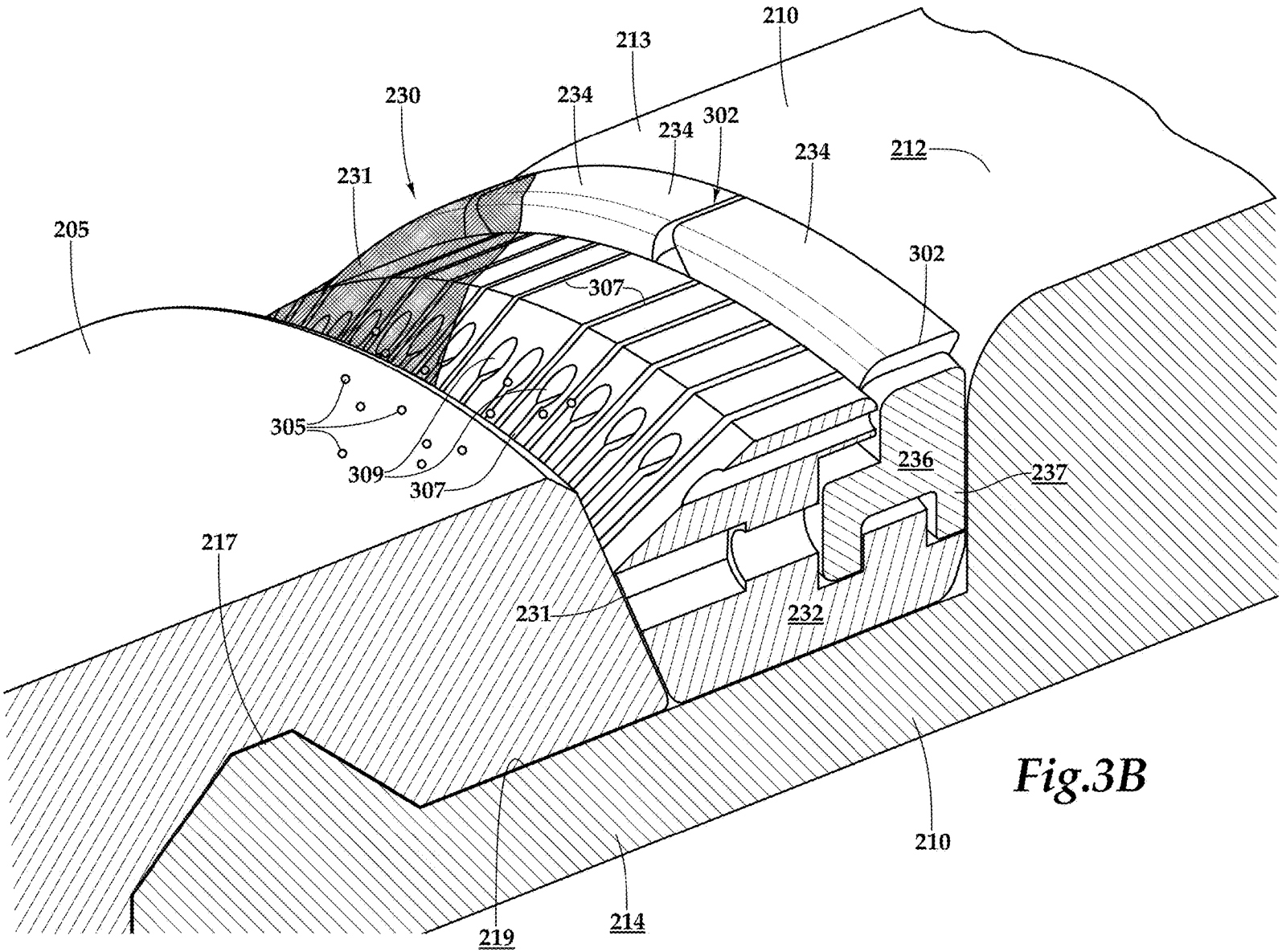

FIGS. 3A-3B illustrate perspective views of a proximal portion of seal apparatus 200 of FIG. 2, in accordance with various embodiments. As shown in FIG. 3A, metal expansion ring 232, outer wedges 234, and inner wedges 236 are all positioned in a recess located between the distally facing surface 205 of the movable seal block 204 and the proximal end 213 of the main body of sealing element 210, and are all enclosed within fabric barrier sleeve 231. Debris 305 is included in FIG. 3A as an illustrative representation of debris that may be present in the wellbore where seal apparatus 200 may be positioned and deployed. The inclusion of fabric barrier sleeve 231 as part of assembly 230 is configured to prevent debris 305 from reaching areas within the fabric barrier sleeve, including preventing the debris from reaching the slots, apertures, and gaps that may be present within and between the metal expansion ring 232 and wedges 234 and 236. In addition, the distally facing surface 237 of the fabric barrier sleeve 231 may also aid in restriction of extrusion of the sealing element 210 in a proximal direction through these same gaps in the wedges 234, 236 when the seal assembly has been actuated to the sealing configuration.

FIG. 3B illustrates metal expansion ring 232, outer wedges 234, and inner wedges 236 as all positioned in a recess located between the distally facing surface 205 of the movable seal block 204 and the proximal end 213 of the main body of sealing element 210, but with a portion of the fabric barrier sleeve 231 illustratively removed to shown various slots 307 and apertures 309 that are provided in metal expansion ring 232, and gaps 302 that may be present between wedges 234 and 236. Without the assembly 230 being entirely enclosed within the fabric barrier sleeve 231, debris 305 could possibly enter into and clog one or more of slots 307, apertures 309, and gaps 302, and thereby interfere with the contraction of assembly 230 during de-actuation of the seal apparatus 200. Use of the fabric barrier sleeve 231 may limit or completely prevent any of debris 305 from coming into contact with the components of assembly 230, and thus prevent the debris from interfering with the retraction of assembly 230 during de-actuation of the seal apparatus. Even in instances where there may be rips or other perforations extending through fabric barrier sleeve 231, the remaining intact portion(s) of the fabric barrier sleeve 231 may still reduce the amount of debris 305 that could potentially reach the slots, apertures and/or gaps that might be present in the components of assembly 230 and that may at least be partially enclosed by the fabric barrier sleeve.

FIGS. 4A-4D illustrate more detailed views of individual components that may be included an extrusion limitation apparatus, in accordance with various embodiments.

Figure 4A:
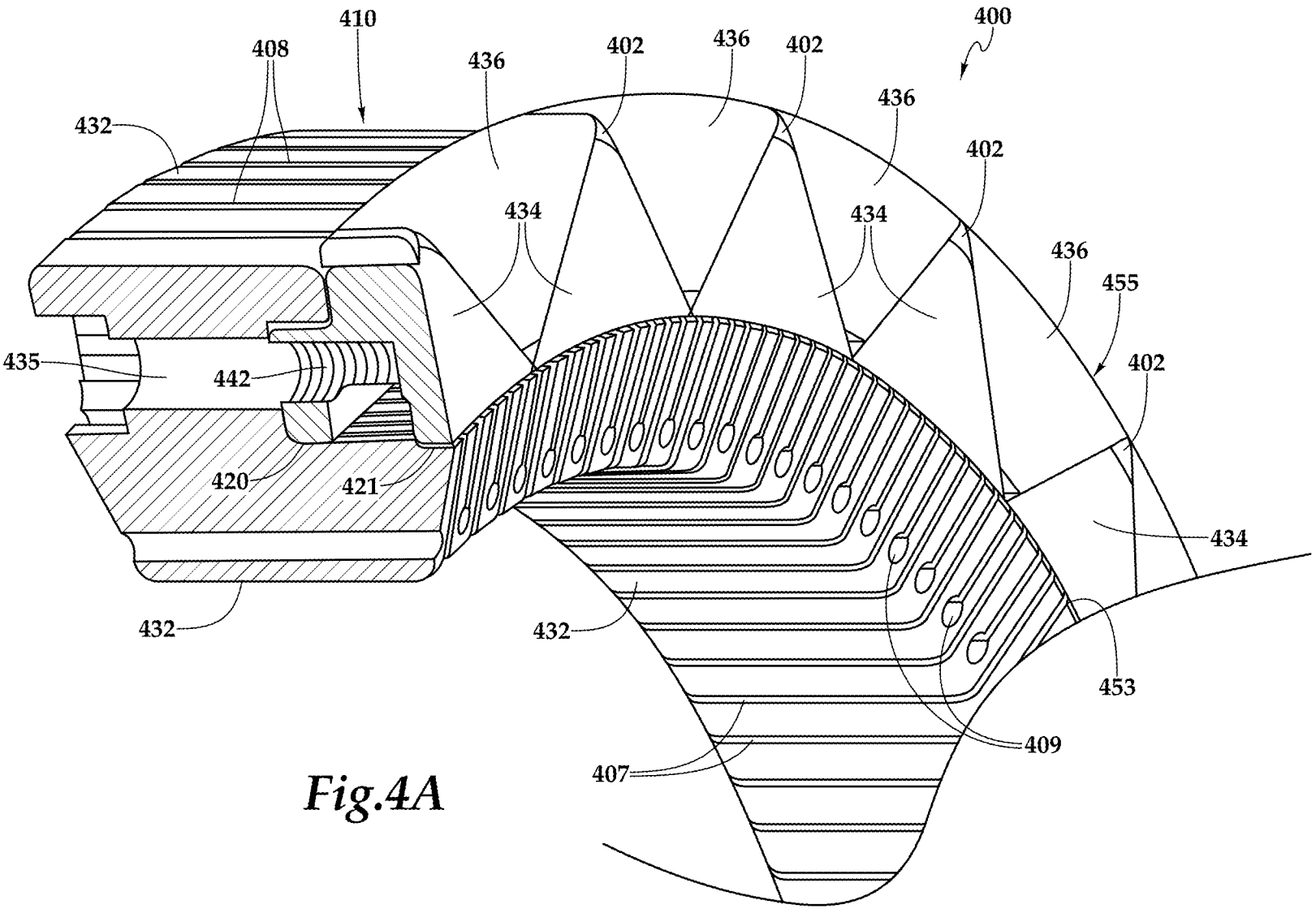
FIG. 4A illustrates a perspective and partial view of an extrusion limitation assembly 400, in accordance with various embodiments.

FIG. 4A illustrates a perspective and partial view of an extrusion limitation assembly 400, in accordance with various embodiments. Extrusion limitation assembly 400 (hereinafter "assembly 400"), may be an embodiment of a component of any of the extrusion limitation assemblies described in this disclosure, including but not limited to assembly 230 and assembly 240, as described above with respect to FIGS. 2 and 3A-3B. As shown in FIG. 4A, assembly 400 is not enclosed in a fabric barrier sleeve, but when incorporated into a sealing assembly such as seal apparatus 200 (FIG. 2), assembly 400 may be entirely enclosed in a fabric barrier sleeve such as fabric barrier sleeve 231 or fabric barrier sleeve 241, (as also shown and described with respect to FIG. 2).

Referring to FIG. 4A, assembly 400 includes two annular members 410 and 411. The first annular member 410 comprises the metal expansion ring 432. A portion of the metal expansion ring 432 is cut away to facilitate location of the second annular member 411. A recess 420 in the first annular member 410, together with a ridge, or lug, located circumferentially at the aperture 421, provides for an interlocking arrangement to hold the second annular member 411 together with the first annular member 410. The ridge is split at an aperture 421 to allow wedges 434, 436 to be inserted into the recess 420 and then moved over the ridge to interlock therewith. The metal expansion ring 432 includes a plurality of slots 407, 408, that extend partially through the body of the ring, and thereby allow for radial expansion and contraction of the ring. A first set of slots 408 terminate in circular shaped apertures 409, which further aid in the ability of the metal expandable ring 432 to expand and contract in the radial direction.

The second annular member 411 comprises a plurality of wedges 434, 436. Each wedge is substantially a wedge shape side surface, including inner wedges 434 and outer wedges 436, which are oppositely arranged around a circumference of the first annular member 410.

The outer wedges 436 provide an outer surface that forms an outer circumference 455 around the outermost portion radially of the second annular member 411. The inner wedges 434 provide a base surface that forms an inner circumference 453 around a mid-point of the side face of assembly 400. When arranged as shown in FIG. 4A, the combination of the inner wedges 434 and the outer wedges 436 form a continuous side face to assembly 400 that may be positioned adjacent to a main body portion of a sealing element, and is configured to expand radially outward as the sealing element is actuated in order to provide an extrusion barrier to the end portion of the sealing element adjacent to the second annular member 411 as the sealing element expands to form a seal.

At regular intervals around the ring 432, access apertures 435 are also cut from the body of the ring. Access apertures 435 provide clearance for the insertion of screws or a threaded fastener (not shown in FIG. 4A), the screw or threaded fastener configured to couple the ring 432 and the support ring comprising the wedges 434, 436 together. In various embodiments, access apertures 435 are elongate to allow the screws or threaded fasteners to move as the assembly 400 is radially expanded or contracted. In various embodiments, wedges 434 that are adjacent to apertures 435 include threaded holes 442 configured to receive the fasteners provided through apertures 435 and used to secure metal expansion ring 432 to the wedges.

Once actuated to aid in preventing extrusion of a sealing element, assembly 400 may develop gaps 402, for example at or near the end portions of wedges 434 and 436. Further, slots 407 and 408, along with apertures in the metal expansion ring 432, such as apertures 409, could be exposed to debris present in the area of the wellbore or tubing where a seal apparatus comprising assembly 400 is located. By using fabric barrier sleeve to enclose the assembly 400, the issue of debris clogging the slots, aperture and gaps that may be present in the actuated assembly 400 may be reduced or completely eliminated, thereby better assuring that the assembly 400 will be able to properly contract to an acceptable shape and size during de-actuation of the seal apparatus the includes assembly 400 enclosed in a fabric barrier sleeve.

Figure 4B:
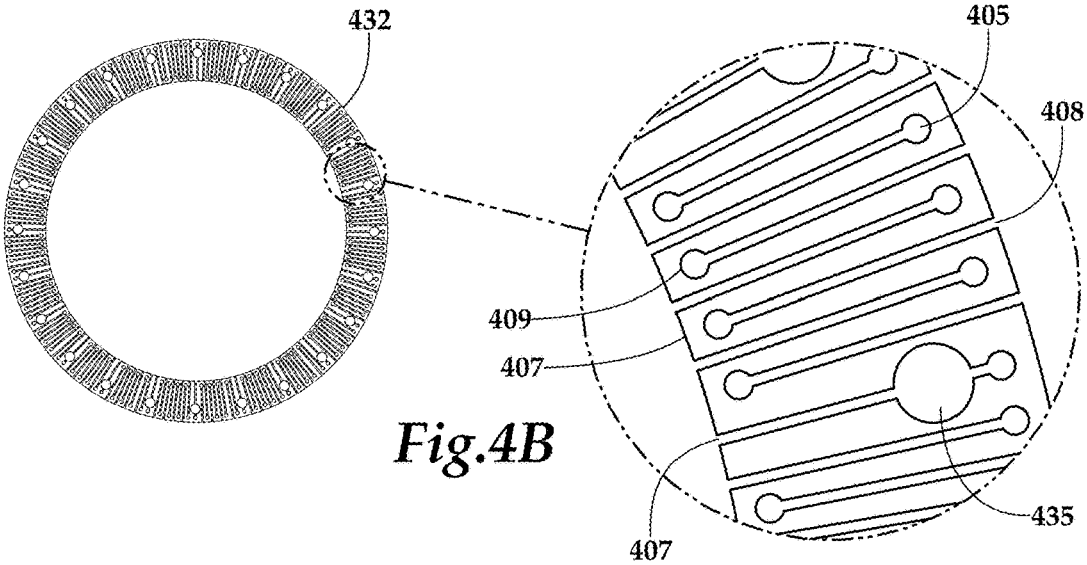
FIG. 4B illustrates a side view of the metal expandable ring of FIG. 4A, and enlarged details thereof, in accordance with various embodiments.

FIG. 4B illustrates a side view of metal expansion ring 432 of FIG. 4A, and enlarged details thereof, in accordance with various embodiments. In various embodiments of the metal expansion ring 432 is formed in an annular ring shape and is constructed from a material comprising metal or a metal alloy, such as steel. A number of radial slots, which may have been laser cut or otherwise formed in the metal expansion ring 432, include a number of inner slots 407, and a number of outer slots 408. The inner slots 407 and the outer slots 408 are spaced alternately around a circumference of the ring 432. and each of the slots terminates in a substantially circular shaped aperture. As shown in FIG. 4B, the inner slots 407 extend radially and partially through the ring 432, beginning at the inner circumference of the ring, wherein each of the slots 407 terminates in an aperture 409. Each of the outer slots 408 extend radially and partially through the ring 432, beginning at the outer circumference of the ring, and wherein each of the slots 408 terminates an aperture 405. The apertures 405, 409 assist in allowing the ring 432 to expand as it is increased radially outwardly, and to retract when released. These features give the ring 432 a sprung nature so that the ring is flexible and can take up a number of shapes. In this way, though the ring 432 may ideally remain circular in shape, it can become oval, for example, to match any distortion in the other components.

At regular intervals around the ring 432, access apertures 435 are also cut from the body of the ring. Access apertures 435 provide clearance for the insertion of screws or a threaded fastener (not shown in FIG. 4B), the screw or threaded fastener configured to couple the ring 432 and the support ring comprising the wedges 434, 436 together. In various embodiments, access apertures 435 are elongate to allow the screws or threaded fasteners to move as the assembly 400 is radially expanded or contracted.

Figure 4C:
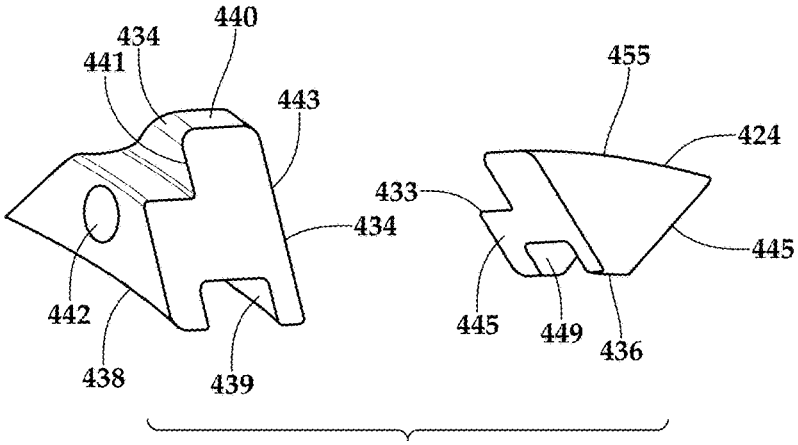
FIG. 4C illustrates perspective views of an inner wedge and an outer wedge of the assembly of FIG. 4A, in accordance with various embodiments.

FIG. 4C illustrates perspective views of an inner wedge 434 and an outer wedge 436, in accordance with various embodiments. As shown in the right hand side of FIG. 4C, outer wedges 436 provide a base outer surface 424 with a first radius having a curvature of outer circumference 455, side walls 445 that abut with corresponding side walls 443 on the inner wedges 434, and a rounded apex 470 having a second radius having a curvature of inner circumference 453. A lip 433 is formed to interlock in recess 420 of ring 432 and a square cross sectional recess 449 is provided on an inner circumference of the wedge 434 to engage with the ridge.

As shown in the left hand side of FIG. 4C, inner wedges 434 provide a base 438 with a radius of curvature matching the inner radius of curvature of inner circumference 453 (FIG. 4A). Inner wedge 434 also includes side walls 443 which abut with corresponding side walls 445 on the outer wedges 436. Inner wedge 434 further includes a rounded apex 440 matching an outer radius of curvature of outer circumference 455 (FIG. 4A). There is also a lip 441 configured to engage the recess 420 and a square cross sectional recess 439 is provided on an inner circumference of the wedge 434 configured to engage with the ridge. Additionally, the inner wedge 434 includes a threaded hole 442, located on a portion of the wedge that is positioned within the recess 420 when wedge 434 is in place. In this way a cap screw (not shown in FIG. 4C) may be inserted through the access aperture 435 on the ring 432 and used to loosely fit each inner wedge 434 to the ring 432. This arrangement also ensures that the wedges 434 and 436 are evenly distributed around the inner circumference 453.

Figure 4D:
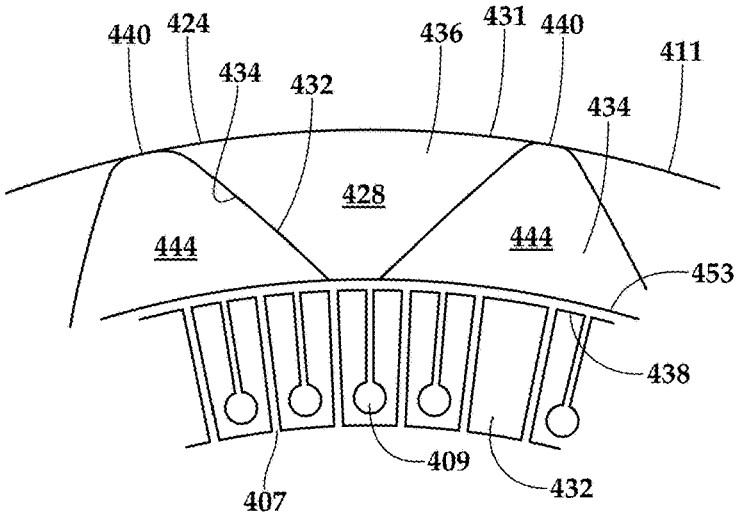
FIG. 4D illustrates a partial side view of the assembly of FIG. 4A, in accordance with various embodiments.

FIG. 4D illustrates a partial side view of assembly 400, in accordance with various embodiments. As shown in FIG. 4D, metal expansion ring 432 extends in a curved arrangement and in a radially inward position relative to wedges 434, 436. Wedges 434 and 436 are arranged in a curved arrangement in an alternating manner, extending between inner circumference 453 and outer circumference 455, and in a position that is radially outward from the position of at least the portions of metal expansion ring 432 that are visible in FIG. 4D. Side faces 444 of each of the inner wedges 434, in conjunction with the side faces 428 of each of the outer wedges, extend between sides 443 of the inner wedges and sides 445 of the outer wedges to form a continual side surface for assembly 400. This continuous side surface is configured to be expandable in a radially outward direction as the seal apparatus that include assembly 400 is actuated, and thereby provide support to the sealing element of the seal apparatus to limit or eliminate extrusion of the sealing element over the outer circumference 455 of the assembly 400. However, as noted above, this radially outward expansion of the side surfaces may cause gaps to form at various places around the wedges. The use of the fabric barrier sleeve to enclose the assembly 400 may be used to limit or completely eliminate the issue of debris from the wellbore clogging these gaps and thus preventing the assembly 400 from properly contracting to a non-actuated configuration when the sealing apparat that includes assembly 400 is being de-actuated.

FIG. 5 illustrates a side partial view of a portion of a sealing element 500 including a wire reinforcement structure 520, in accordance with various embodiments. The portion of sealing element 500 as shown in FIG. 5 may represent embodiments of the proximal end of sealing element 210 as described above and as illustrated in FIG. 2 and/or in FIGS. 3A-3B. The outer surfaces of the portion of the sealing element 500 as shown in FIG. 5 are illustrated as broken lines, in effect are "ghosted," in order to illustrate the arrangement and positioning of the wire reinforcement structure 520 that is embedded internally within the material forming the sealing element.

As shown in FIG. 5, portions of sealing element 500 include a main body 502 generally indicated by bracket 514, a proximal narrowed portion 503 generally indicated by bracket 512 and located proximally of the main body 502, and a pull ridge 507 generally indicated by bracket 510 and located proximally of the proximal narrowed portion 503. Embodiments of the wire reinforcement structure 520 include a first reinforcement ring 522 positioned at and embedded within the material of the sealing element 210 forming the pull ridge 507, a second reinforcement ring 524 positioned at the proximal end and embedded within the material of the sealing element 500 forming the proximal end of the main body 502 of the sealing element, and a plurality of reinforcement wires 523 extending between and coupled to the first reinforcement ring 522 at a respective first end of each of the reinforcement wires, and coupled to the second reinforcement ring 524 as a respective second end of each of the reinforcement wires that is opposite the respective first end of the reinforcement wires. The reinforcement wires 523 may be arranged in a circular pattern and spaced apart from one another around the circular pattern, extending around the circumference and embedded within the material forming the narrowed portion 503 of the sealing element 500. The first reinforcement ring 522 and the second reinforcement ring 524 each encircle entirely the longitudinal axis 501 and at a distance radially from the longitudinal axis so that the each of the rings are positioned outside of the inner passageway 530 extending longitudinally through the sealing element 500, and therefore are completely embedded within the material forming the sealing element. In addition, the radial positioning of the reinforcement wires 523 are such that the reinforcement wires extend through the sealing element 500 at a distance radially away from longitudinal axis 501 so that the reinforcement wires in their entirety are positioned outside of the inner passageway 530, and are also completely embedded within the material forming the sealing element.

When a sealing element 500 that includes the embedded wire reinforcement structure 520 is actuated to form a seal, the compression of the sealing element, as illustratively represented by arrow 560, may cause the first reinforcement ring 522 to be moved distally to a position that is closer to the second reinforcement ring 524. The change in the positioning of the first reinforcement ring 522 relative to the second reinforcement ring 524 is accommodated by compression and/or flexation of the plurality of reinforcement wires 523, while each of the reinforcement wires remains coupled to both the first reinforcement ring 522 and to the second reinforcement ring 524.

When a sealing element 500 that includes the wire reinforcement structure 520 is being de-actuated to release the seal formed by sealing element 500, and/or as the seal apparatus that includes sealing element 500 is being retrieved from a position within another conduit and/or a wellbore, a force may be applied for example to the pull ridge 507. This proximally directed pull force is illustratively represented by arrow 562. As the proximally directed pulling force is applied, the pull ridge 507, the narrowed portion 503, and the main body 502 of the sealing element 500 may be stretched to the extent allowed by the collective lengths of the reinforcement wires 523 in order to allow some proximal movement of the position of the first reinforcement ring 522 relative to the position of the second reinforcement ring 524. When the distance of separation between the first reinforcement ring 522 and the second reinforcing ring 524 reaches the longitudinal length of the plurality of reinforcement wires 523, any further proximally directed forces applied to the pull ridge 507 are also transferred from the first reinforcement ring 522 to the second reinforcement ring 524 through the reinforcement wires 523. This feature of allowing the transfer of force increases the level of force that may be applied proximally to the sealing element 500 as part of de-actuating the sealing assembly comprising the sealing element 500 to move the seal assembly that includes sealing element 500 to an unsealed configuration, and/or as part of extracting of the sealing assembly comprising the sealing element from a conduit and/or a wellbore. In addition, the embedded wire reinforcement structure 520 may allow for extraction of the sealing assembly even in instances wherein the material forming the sealing element 500 has been torn or separated into more than a single piece of material, for example in the narrowed portion 503 of the sealing element.

Inclusion of the wire reinforcement structure 520, or any equivalent thereof, as part of a sealing element further enhances retrievability of the seal apparatus that includes the sealing structure. It is an assembly that can be embedded into the sealing element. In various embodiments, the rings and reinforcement wires are formed from a material such as but not limited to metal or a metal alloy. In various embodiments, when making the sealing element with the wire reinforcement structure, the reinforcement wires are installed with slight tension during the molding process. The first ring is placed at the ends and are constrained by the lugs that will be assembled over the elastomer ends. The second ring is placed closer to the main sealing area. In various embodiments, the routing of the reinforcement wires 523 follows the profile of the material forming the portions of the sealing element between the rings.

When the elastomer forming the sealing element is deployed using mechanical force to actuate a seal using the sealing element, the wire is relaxed slightly. On retrieval of the seal apparatus, when the lugs are pulled, the elastomer and metal ring under the lugs will be pulled together. If the elastomer between the gauge ring and the sealing area breaks or tears during retrieval, the metal wires hold the two parts together and acts as a reinforcement mechanism to keep the element moving into a relaxed state for pulling out of the well. The material of the ring and wire can be changed to any suitable material that can sustain the retrieval forces and conform to the well conditions. Alternatively, the reinforcement wires can be changed to springs to provide more hold within the elastomer and provide more reinforcement.

FIG. 6A illustrates a seal apparatus 600 including a seal debris barrier in an unactuated configuration, in accordance with various embodiments. As shown in FIG. 6A, seal apparatus 600 includes a debris barrier 640 positioned proximally of a movable seal block 604 coupled to a sealing element 610. The movable seal block 604 may be positioned proximally and in contact with an extrusion limitation barrier 611, and engaged with a proximal end 612 of sealing element 610. A distal barrier block 650 is positioned proximally of the movable seal block 604, and encircles and is in contact with an outer surface 603 of the tool body 602 of the seal apparatus 600. A proximal barrier block 656 also encircles the outer surface 603 of the tool body 602, and is spaced proximally away from the distal barrier block 650 by an opening 655. A distally facing sloped surface 645 located at the distal end of the debris barrier 640 is positioned in a notch 652 formed along the outer surface 651 of the distal barrier block 650. A proximally facing sloped surface 643 located at the proximal side of the debris barrier 640 is positioned in a notch 658 formed along the outer surface 657 of the proximal barrier block 656. A bottom surface 643 of the debris barrier 640 extends between notch 652 and notch 658, and spans across the top of opening 655.

A top surface 641 of debris barrier 640 is positioned in a radially outward facing ring shaped configuration that encircles the notch 652, the notch 658, and the opening 655. Along top surface 641 includes a set of recesses formed as grooves that encircle the debris barrier 640 radially, each of the grooves including a sealing element or sealing ring 642. When in the unactuated configuration, the top surface 641 of debris barrier 640 may be flush in a radial distance with the outermost surface of the movable seal block 604 and the outermost surfaces radially of both the distal barrier block 650 and the proximal barrier block 656, When actuated, debris barrier 640 is configured to move in a radially outward direction, as illustratively represented by arrow 661, to extend into annulus 632 to a position having sealing rings 642 and top surface 641 be brough into contact with an inner surface 631 of, for example, another conduit 630 that the sealing assembly 600 has been positioned adjacent to.

The actuation of the debris barrier 640 may be accomplished by moving the proximal barrier block 656 in a distal direction, as illustratively represented by arrow 660. This movement of the proximal barrier block 656 is done while holding the distal barrier block 650 at a fixed position longitudinally, and thereby closing or completely eliminating the spacing initially provided by opening 655. In addition to closing or eliminating the space initially provide by opening 655, a distal direction movement of the proximal barrier block 656 also urges debris barrier 640 to move outward radially due to the forces that are incurred by this movement along the sloped surfaces of the debris barrier and the notches 652 and 658. In addition, if after movement of the proximal barrier block 656 the position of the proximal barrier block is then maintained, debris barrier 640 will be urged by static force applied to the debris barrier by the sloped surfaces of the notches 652 and 658, and thus will be maintained in a location where the debris barrier 640 blocks off the proximal portion of annulus 632, and can therefore reduce or completely prevent debris that might be present proximally of the debris barrier in annulus 632 from reaching the other parts of the seal apparatus 600 that are positioned distally of the actuated debris barrier.

FIG. 6B illustrates the seal apparatus 600 of FIG. 6A including debris barrier 640 in an actuated configuration, in accordance with various embodiments. As shown in FIG. 6B, proximal barrier block 656 has been repositioned longitudinally in a distal direction, resulting in the closing of the space provided by opening 655 compared to when the debris barrier was in the unactuated configuration. The actuation of the debris barrier has also resulted in the debris barrier 640 moving radially outward so that at least sealing rings 642 are brought into contact with the inner surface 631 of conduit 630. In various embodiments, top surface 641 may also be brought into contact with the inner surface 631. As shown in FIG. 6B, debris particles 605 that may be present in the proximal portion of annulus 632 are blocked from coming into contact with portions of the seal apparatus that are positioned distally of the debris barrier, such as sealing element 610 and extrusion limitation barrier 611. By blocking the debris particles 605 as shown in FIG. 6B, debris barrier 640 helps prevent the debris particles from clogging various components of the sealing assembly, which potentially prevents the components of the sealing assembly from fully contracting back to the original or near original dimensions when the sealing element is de-actuated, and thus increases the ability to retrieve the seal apparatus 600 from conduits and/or from a wellbore where the sealing elements had previously been actuated.

As part of de-actuation of the sealing element 610, the proximal barrier block 656 may be moved in a proximal direction, as illustratively represent by arrow 662, allowing a space to reopen in opening 655, and allowing debris barrier 640 to move in a radially inward direction along the sloped surfaces of notches 652 and 658. In various environments, debris barrier 640 is formed from an elastomeric material, such as but not limited to rubber or polyetheretherketone (PEEK), which naturally will cause the debris barrier to return to the more radially inward position, as shown in FIG. 6A, as part of the de-actuation process, and thereby allow for better clearance of the debris barrier relative to other conduits or tubing sections as part of the retrieval process for removal of the seal apparatus 600 from a wellbore system. In various embodiments, the sealing rings 642 and/or the debris barrier 640 itself are not meant to act as a pressure barrier, but rather just a debris barrier that can work together with the seal apparatus that include sealing element(s) as described throughout this disclosure.

Figure 7:
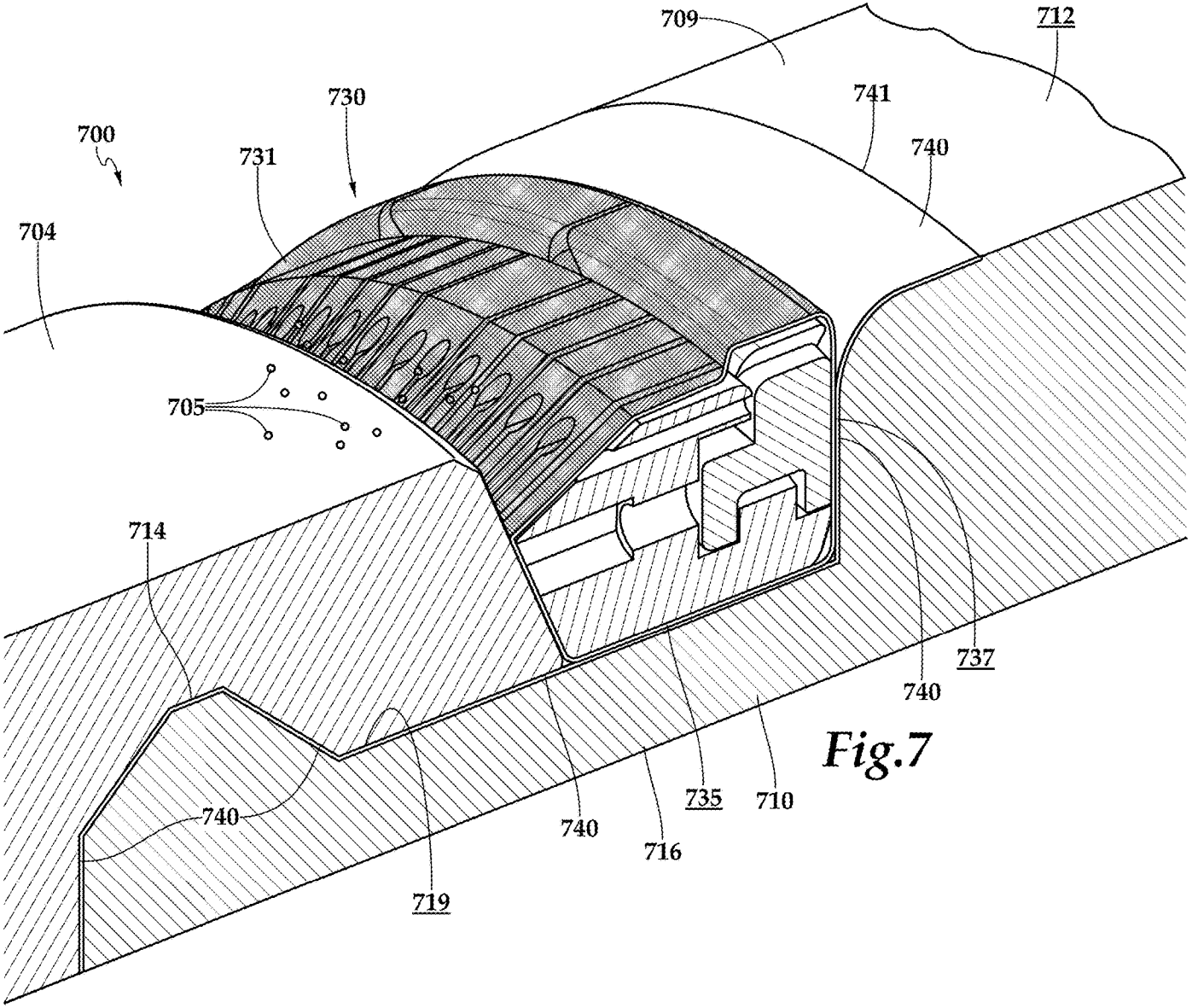
FIG. 7 illustrates a seal apparatus, in accordance with various embodiments.

FIG. 7 illustrates a proximal portion of a seal apparatus 700, in accordance with various embodiments. As shown in FIG. 7, seal apparatus 700 includes sealing element 710 having a main body 709, a narrowed portion 716 extending proximally from the main body 709, and a pull ridge 714 at the proximal end of the narrowed portion 716. Sealing element 710 includes an extrusion limitation assembly 730, which may be enclosed within a fabric barrier sleeve 731, the extrusion limitation assembly 730 is configured to provide any of the features and to perform any of the functions ascribed above with respect to extrusion limitation assembly 230 and fabric barrier sleeve 231, respectively, (FIG. 1).

As further shown in FIG. 7, seal apparatus 700 includes a fabric reinforcement layer 740. Fabric reinforcement layer 740 may be fused or otherwise physically coupled to various outer surfaces of sealing element 710. For example, the distal end 741 of fabric reinforcement layer 740 may overlap for some distance longitudinally with outer surface 712 of the main body 709 of sealing element 710. Fabric reinforcement layer 740 extends from distal end 741 along the outer surface 712 of main body of the sealing element 710, and then turns inward radially to contact a proximal facing surface 737 of assembly 730, then extends along an outward facing surface 719 of the sealing element over the narrowed portion 716, and further extends up, over, and then inward radially to cover over the outer surfaces of the sealing element 710 used to form the pull ridge 714. The movable seal block 704 extends over the outward facing surfaces of the pull ridge 714 and a portion of the outward facing surface 719 of the narrowed portion 716, and is configured to perform the compression and retrieval functions related to seal apparatus 700 as ascribed to the movable seal block 204 described above with respect to seal apparatus 200 (FIG. 2) but now incorporating the fabric reinforcement layer 740 positioned between the movable seal block 704 and the adjacent surfaces of the sealing element 210. The fabric reinforcement layer 740 follows the described path formed as a continuous fabric sheet or layer that encircles the sealing assembly completely in the radial direction.

One objective of the fabric reinforcement layer 740 is to prevent extrusion of the sealing element 710 during pressure retention. The fabric reinforcement layer 740 acts as a high-density net that keeps the rubber or other material used to form the sealing element 710 in place. In addition, during retrieval of seal apparatus, especially those used in bridge plugs, the mode of de-actuation to retrieve could be a fast mechanical action to pull up a retrieving sleeve within the tool. This quick motion imparts a substantial amount of instantaneous axial force to the gauge ring components of the assembly 730, jerking it upwards. In the case where the element is tied to the gauge ring through the lugs, that force is transferred to the elastomer of sealing element 710 as well, and allows it to relax back down from the previously energized stated. However, if the sealing element is damaged or weakened during operations, the sealing element might tear or break during retrieval, resulting in the elastomer not relaxing completely, and thus hindering the retrieval operations. The fabric reinforcement layer 740 assists to keep the portions of the sealing element together as the lugs stretch out the portions of the sealing elements from the actuated and compressed state. Even in instances wherein the elastomer of the sealing element 710 tears or breaks, the fabric reinforcement layer 740 should remain intact and keep stretching the elastomer of the sealing element until it returns to at or near the sealing element's pre-activation dimensions.

Figure 8:
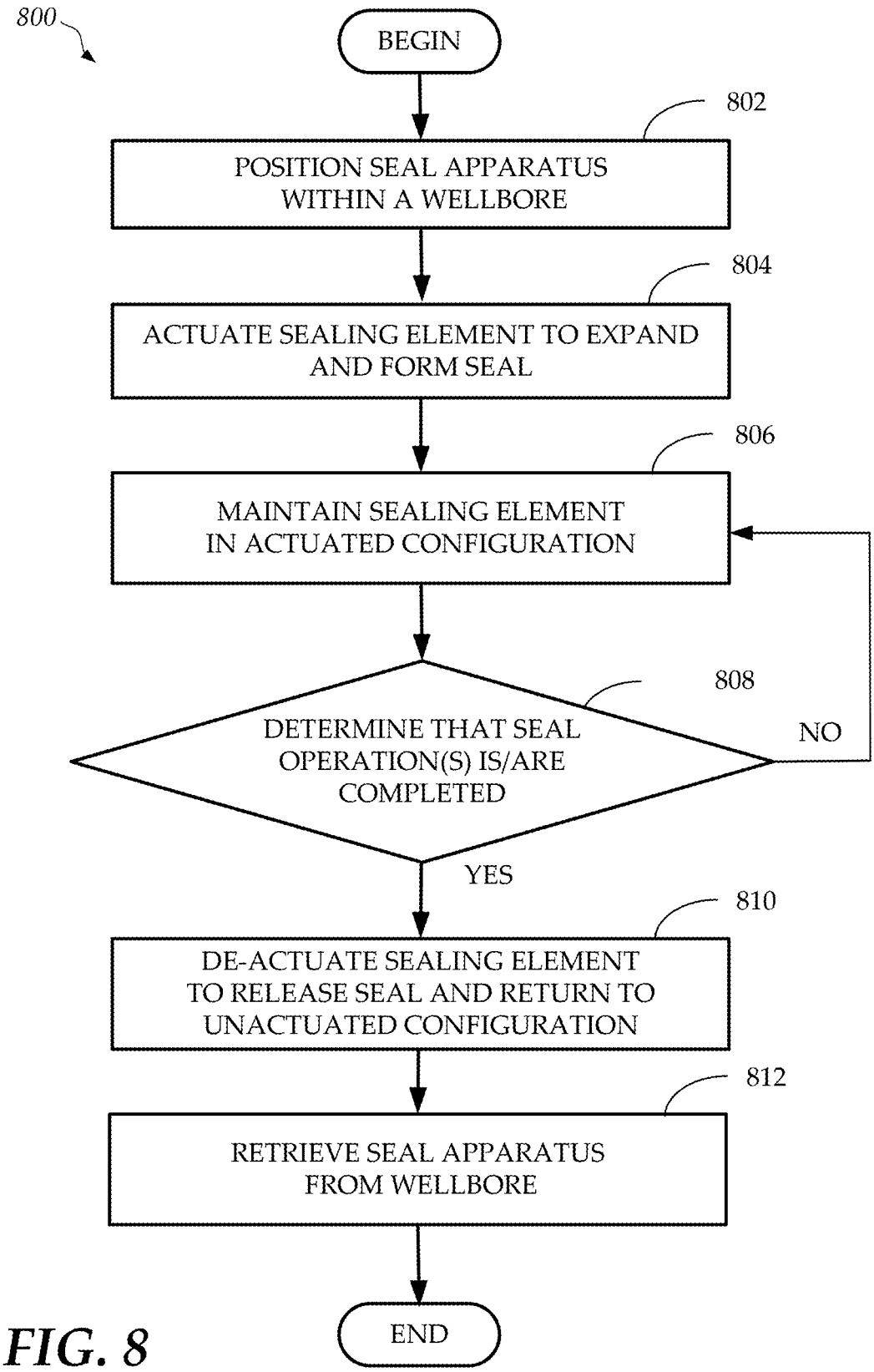
FIG. 8 illustrates a flowchart of a method for operation of a packer apparatus within a wellbore, in accordance with various embodiments.

FIG. 8 illustrates a flowchart of a method 800 for operation of a seal apparatus within a wellbore, in accordance with various embodiments. Embodiments of method 800 may be performed by one or more devices included in a wellbore system, such as system 100 as illustrated and described with respect to FIG. 1. One or more of the seal apparatus as described throughout this disclosure, such as seal apparatus 200 (FIGS. 2 and 3A-3B), and/or any of the variations of a seal apparatus as described throughout this disclosure, may be utilized in the execution of the steps performed by method 800.

Embodiments of method 800 include positioning a seal apparatus within a wellbore, (block 802). The positioning of the seal apparatus is performed with the sealing element of the seal apparatus being provided in a non-activated configuration, such that the sealing element of the seal apparatus has not been actuated, for example by lateral compression, to expand in a radially outward direction away from a tool body of the seal apparatus. In various embodiments, positioning the seal apparatus includes positioning of the unactuated sealing element adjacent to an inner surface of a conduit or other tubing at a location where the sealing element is going to be actuated in order to form a seal between the inner surface and the tool body of the seal apparatus. In various embodiments, positioning the seal apparatus includes positioning of the unactuated sealing element adjacent to an inner surface of an open hole portion of a wellbore where the sealing element is going to actuated in order to form a seal between the open hole portion of the wellbore and the tool body of the seal apparatus.

In various embodiments, the seal apparatus includes one or more extrusion limitation apparatus configured to limit or completely prevent extrusion of the sealing element in a proximal and/or a distal direction longitudinally upon actuation of the sealing element, wherein the expandable components forming the extrusion limitation apparatus are enclosed in a respective expandable fabric barrier sleeve, such as but not limited to fabric barrier sleeve 231 or 241 as illustrated and described with respect to FIG. 2. In various embodiments, the seal apparatus includes a wire reinforcement structure that is embedded in a portion such as the proximal potion, of the sealing element, such as but not limited to the wire reinforcement structure 520 as illustrated and described with respect to FIG. 5. In various embodiments, the seal apparatus includes one or more debris barriers, positioned proximally, distally or both proximally and distally of the sealing element, such as but not limited to debris barrier 640 as illustrated and described with respect to FIGS. 6A-6B. In various embodiments, the seal apparatus includes a fabric reinforcement layer that is fused or otherwise bonded to outward facing surface(s) of the sealing element, such as but not limited to fabric reinforcement layer 740 as illustrated and describe with respect to FIG. 7.

Embodiments of method 800 include actuating the sealing element of the seal apparatus to form a seal, (block 804). In various embodiments, actuation of the sealing element includes applying a compressive force in a longitudinal direction to at least a main body portion of the sealing element, the compressive force configured to cause a top or outward facing surface of the sealing element to move in a radially outward direction until the top or outer surface contacts another surface positioned adjacent to the sealing element, and forms a seal between the tool body of the seal apparatus and the another surface. In various embodiments, actuation of the sealing element further includes actuation of one or more debris barriers positioned proximally, distally, or both proximally and distally of the sealing element, and provided as part of the seal apparatus, wherein the debris barrier(s) when actuated form a physical barrier between the tool body of the seal apparatus and the surface positioned adjacent to the sealing element. Embodiments of the debris barrier may include but are not limited to the debris barrier 640 and associated sealing rings 642 and barrier blocks 650, 656 (FIG. 6).

Embodiments of method 800 include maintaining the sealing element in an actuated configuration, (block 806). Maintaining the sealing element in an actuated configuration may include maintaining the relative positioning between a movable seal block and a stationary seal block so that the longitudinally compressive force being applied to the sealing element of the sealing assembly is maintained. Maintaining the sealing element in an actuated configuration may further include maintaining any debris barrier(s) positioned proximally and/or distally of the sealing element in the actuated configuration with the debris barrier blocking off a portion of the annulus surrounding the sealing apparats from debris that might otherwise be in contact with the extrusion limitation apparatus.

Embodiments of method 800 include determining that the operation(s) requiring the seal have been completed, (decision block 808). In various embodiments, the determination may be made based a determination that the wellbore operation(s) that required the seal being provided by the actuation of the sealing element of the seal apparatus have been completed, and/or that other well operations need to be performed that require the removal of the seal. If a determination is made at decision block 808 that the operation(s) requiring the seal have not been completed, (the "NO" branch extending from decision block 808), then embodiments of method 800 may return to block 806, wherein the seal apparatus maintains the sealing element in the actuated configuration. If a determination is made at decision block 808 that the operation(s) that require the seal have been completed, and/or that other well operations need to be performed that require the removal of the seal, (the YES" branch extending from decision block 808), then embodiments of method 800 may proceed to block 810.

At block 810, embodiments of method 800 include deactuating the sealing element to return the sealing element to an unactuated configuration. In various embodiments, deactuation of the sealing element includes removing the application of the compressive force that has been applied to at least the main body portion of the sealing element, Thereby allowing a top or outward facing surface of the sealing element contract, by moving in a radially inward direction until the top or outer surface of the sealing element is no longer in contact with the adjacent surface where the sealing element had been actuated in order to form a seal between the tool body of the seal apparatus and the adjacent surface. In various embodiments, deactuation of the sealing element further includes allowing any extrusion limitation assemblies to contract back to their pre-actuation dimensions, wherein one or more of the extrusion limitation assemblies have components that are enclosed in a fabric barrier sleeve. In various embodiments, deactuation of the sealing element includes stretching the sealing element longitudinal by applying force to a pull ridge of the sealing element in a proximal direction. In various embodiments, the pull ridge and/or some proximal portion(s) of the sealing element includes a wire reinforcement structure configured to aid in transferring the applied pulling force to the main body of the sealing element. In various embodiments, the pull ridge and/or some proximal portion(s) of the sealing element includes a fabric reinforcement layer fused or otherwise coupled to one or more surfaces of the sealing element, the fabric reinforcement layer configured to aid in transferring the applied pulling force to the proximal portion and/or to the main body of the sealing element. In various embodiments, deactuation of the seal assembly includes deactuation of one or more debris barriers positioned proximally, distally, or both proximally and distally of the sealing element, and provided as part of the seal apparatus.

Embodiments of method 800 include retrieving the seal apparatus from the wellbore, (block 812). In various embodiments, retrieval of the seal apparatus from the wellbore includes applying a pulling force in a proximal direction to a pull ridge formed at the proximal end of the sealing element. In various embodiments, retrieval of the sealing assembly include having the pulling force applied to the pull ridge transferred through a wire reinforcement structure to a main body portion of the sealing element, for example but not limited to wire reinforcement structure 520 that is embedded within the proximal portions of the sealing element (FIG. 5). In various embodiments, retrieval of the sealing assembly from the wellbore includes applying a pulling force in a proximal direction, at least in part, to a fused fabric layer that is fused onto at least some portion or portions of the outer surface(s) of the sealing element, for example but not limited to the arrangement of fabric reinforcement layer 740, (FIG. 7). In various embodiments, retrieval of the seal apparatus from the wellbore includes raising one or more sections of conduit or tubing (such as conduit 120, 125, FIG. 1), which are coupled to the seal apparatus, up and out of the wellbore using hoist and rigging equipment, such as hoist 114, derrick 112 positioned on platform 110 above surface 101, (system 100, FIG. 1).

While the aspects of the disclosure are described with reference to various implementations and exploitations, it will be understood that these aspects are illustrative and that the scope of the claims is not limited to them. In general, techniques for activating downhole apparatus, including a sealing element of a packer as described herein, may be implemented with facilities consistent with any hardware, software, and other system or apparatus as described herein, and any equivalents thereof. Many variations, modifications, additions, and improvements are possible.

Plural instances may be provided for components, operations or structures described herein as a single instance. Finally, boundaries between various components, operations and are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

EXAMPLE IMPLEMENTATIONS

Example embodiments include the following.

Implementation #1: An apparatus comprising: a seal apparatus configured to be positioned downhole within a wellbore, the seal apparatus comprising a sealing element configured to form a seal between the sealing element and a surface positioned adjacent to the seal apparatus when the sealing element is actuated into a sealing configuration, the seal apparatus further comprising at least one extrusion limitation assembly positioned at an end of the sealing element, the extrusion limitation assembly configured to limit or eliminate a lateral extrusion of the sealing element while the sealing element is actuated into the sealing configuration, the at least one extrusion limitation assembly having a plurality of radially expandable components that are enclosed in a fabric barrier sleeve configured to block debris from coming into contact with the plurality of radially expandable components.

Implementation #2: The apparatus of Implementation #1, wherein the fabric barrier sleeve comprises woven carbon fiber infused with an elastomeric material.

Implementation #3: The apparatus of any one of Implementations #1-2, wherein the plurality of radially expandable components comprises: a metal expandable ring having a plurality of slots extending radially and positioned around a circumference of the metal expandable ring; an inner row of wedges positioned along a side of the metal expandable ring and arranged around the circumference of the metal expandable ring; and an outer row of wedges positioned on the side of the metal expandable ring and interspaced between each of the wedges of the inner row of wedges.

Implementation #4: The apparatus of any one of Implementations #1-3, wherein the sealing element further comprises a wire reinforcement structure embedded within the sealing element.

Implementation #5: The apparatus of Implementation #4, wherein the wire reinforcement structure includes: a first ring embedded within a pull ridge positioned at a proximal end of the sealing element; a second ring embedded within the proximal end of a main body of the sealing element; and a plurality of reinforcement wires extending between and coupled to each of the first ring and the second ring.

Implementation #6: The apparatus of any one of Implementations #1-5, wherein the seal apparatus further comprises a fabric reinforcement layer fused onto one or more outer surfaces of the sealing element.

Implementation #7: The apparatus of Implementation #6, wherein the fabric reinforcement layer comprises a distal end that overlaps onto a proximal end of a main body of the sealing element.

Implementation #8: The apparatus of Implementation #6, wherein the fabric reinforcement layer encircles a proximal portion of the sealing element, and is routed to extend over a proximal end of a main body of the sealing element, underneath a proximal extrusion limitation assembly, along a narrowed portion of the sealing element, and over a pull ridge positioned at a proximal end of the sealing element.

Implementation #9: The apparatus of any one of Implementations #1-8, wherein the seal apparatus further comprises one or more debris barriers configured to be actuatable to close off a portion of an annulus that is positioned adjacent to the sealing element, the debris barriers configured to be actuated to block debris from entering into the portion of the annulus positioned adjacent to the sealing element.

Implementation #10: The apparatus of Implementation #9, wherein each of the one or more debris barriers comprise a ring shaped barrier that encircles a tool body of the seal apparatus and is positioned longitudinally either proximally or distally of the sealing element.

Implementation #11: A system comprising: a bridge plug configured to be positioned within a section of production tubing extending within a wellbore, the bridge plug comprising a seal apparatus including a sealing element configured to form a seal between the seal apparatus and an interior surface of the section of production tubing; and the seal apparatus further comprising at least one extrusion limitation assembly positioned at an end of the sealing element, the extrusion limitation assembly configured to limit or eliminate a lateral extrusion of the sealing element while the sealing element is actuated into a sealing configuration, the at least one extrusion limitation assembly having a plurality of radially expandable components that are enclosed in a fabric barrier sleeve configured to block debris from coming into contact with the plurality of radially expandable components.

Implementation #12: The system of Implementation #11, wherein the fabric barrier sleeve comprises woven carbon fiber infused with an elastomeric material. Implementation #13: The system of any one of Implementations #11-12, wherein the sealing element further comprises a wire reinforcement structure embedded within the sealing element.

Implementation #14: The system of any one of Implementations #11-13, wherein the seal apparatus further comprises a fabric reinforcement layer fused onto one or more outer surfaces of the sealing element.

Implementation #15: The system of any one of Implementations #11-14, wherein the seal apparatus further comprises one or more debris barriers configured to be actuatable to close off a portion of an annulus that is positioned adjacent to the sealing element, the debris barriers configured to be actuated to block debris from entering into the portion of the annulus positioned adjacent to the sealing element.

Implementation #16: A method comprising: positioning a seal apparatus comprising a sealing element in an unactuated configuration at a location downhole within a wellbore, the sealing element configured to form a seal between the sealing element and a surface positioned adjacent to the sealing element when the sealing element is actuated into a sealing configuration, the seal apparatus further comprising at least one extrusion limitation assembly positioned at an end of the sealing element, the extrusion limitation assembly configured to limit or eliminate a lateral extrusion of the sealing element while the sealing element is actuated into the sealing configuration, the at least one extrusion limitation assembly having a plurality of radially expandable components that are enclosed in a fabric barrier sleeve configured to block debris from coming into contact with the plurality of radially expandable components; and actuating the sealing element by applying a laterally compressive force to the sealing element, the laterally compressive force expanding the sealing element in a radially outward direction to form the seal between a tool body of the seal apparatus and the surface positioned adjacent to the sealing element.

Implementation #17: The method of Implementation #16, further comprising: deactuating the seal apparatus to allow the sealing element to return to the unactuated configuration; and retrieving the seal apparatus from the wellbore.

Implementation #18: The method of any one of Implementations #16-17, wherein the sealing element further comprises a wire reinforcement structure embedded within the sealing element.

Implementation #19: The method of any one of Implementations #16-18, wherein the seal apparatus further comprises a fabric reinforcement layer fused onto one or more outer surfaces of the sealing element.

Implementation #20: The method of any one of Implementations #16-19, wherein the seal apparatus further comprises one or more debris barriers configured to be actuatable to close off a portion of an annulus that is positioned adjacent to the sealing element, the debris barriers configured to be actuated to block debris from entering into the portion of the annulus positioned adjacent to the sealing element.

What is claimed is:

1. An apparatus comprising:

a seal apparatus configured to be positioned downhole within a wellbore, the seal apparatus comprising a sealing element configured to form a seal between the sealing element and a surface positioned adjacent to the seal apparatus when the sealing element is actuated into a sealing configuration, the seal apparatus further comprising at least one extrusion limitation assembly positioned at an end of the sealing element, the extrusion limitation assembly configured to limit or eliminate a lateral extrusion of the sealing element while the sealing element is actuated into the sealing configuration, the at least one extrusion limitation assembly having a plurality of radially expandable components that are completely enclosed in a fabric barrier sleeve configured to block debris from coming into contact with the plurality of radially expandable components.

2. The apparatus of claim 1, wherein the fabric barrier sleeve comprises woven carbon fiber infused with an elastomeric material.

3. The apparatus of claim 1, wherein the plurality of radially expandable components comprises:

a metal expandable ring having a plurality of slots extending radially and positioned around a circumference of the metal expandable ring;

an inner row of wedges positioned along a side of the metal expandable ring and arranged around the circumference of the metal expandable ring; and an outer row of wedges positioned on the side of the metal expandable ring and interspaced between each of the wedges of the inner row of wedges.

4. The apparatus of claim 1, wherein the sealing element further comprises a wire reinforcement structure embedded within the sealing element.

5. The apparatus of claim 4, wherein the wire reinforcement structure includes:

a first ring embedded within a pull ridge positioned at a proximal end of the sealing element;

a second ring embedded within the proximal end of a main body of the sealing element; and a plurality of reinforcement wires extending between and coupled to each of the first ring and the second ring.

6. The apparatus of claim 1, wherein the seal apparatus further comprises a fabric reinforcement layer fused onto one or more outer surfaces of the sealing element.

7. The apparatus of claim 6, wherein the fabric reinforcement layer comprises a distal end that overlaps onto a proximal end of a main body of the sealing element.

8. The apparatus of claim 6, wherein the fabric reinforcement layer encircles a proximal portion of the sealing element, and is routed to extend over a proximal end of a main body of the sealing element, underneath a proximal extrusion limitation assembly, along a narrowed portion of the sealing element, and over a pull ridge positioned at a proximal end of the sealing element.

9. The apparatus of claim 1, wherein the seal apparatus further comprises one or more debris barriers configured to be actuatable to close off a portion of an annulus that is positioned adjacent to the sealing element, the debris barriers configured to be actuated to block debris from entering into the portion of the annulus positioned adjacent to the sealing element.

10. The apparatus of claim 9, wherein each of the one or more debris barriers comprise a ring shaped barrier that encircles a tool body of the seal apparatus and is positioned longitudinally either proximally or distally of the sealing element.

11. The apparatus of claim 1, wherein the plurality of radially expandable components being completely enclosed in the fabric barrier sleeve comprises the fabric barrier sleeve enclosing a distal side of the at least one extrusion limitation assembly, a proximal side of the at least one extrusion limitation assembly, an outer side of the at least one extrusion limitation assembly, and an inner side of the at least one extrusion limitation assembly.

12. The apparatus of claim 1, wherein the extrusion limitation assembly has an annular shape and the fabric barrier sleeve has an axially continuous surface.

13. A system comprising:

a bridge plug configured to be positioned within a section of production tubing extending within a wellbore, the bridge plug comprising a seal apparatus including a sealing element configured to form a seal between the seal apparatus and an interior surface of the section of production tubing; and the seal apparatus further comprising at least one extrusion limitation assembly positioned at an end of the sealing element, the extrusion limitation assembly configured to limit or eliminate a lateral extrusion of the sealing element while the sealing element is actuated into a sealing configuration, the at least one extrusion limitation assembly having a plurality of radially expandable components that are completely enclosed in a fabric barrier sleeve configured to block debris from coming into contact with the plurality of radially expandable components.

14. The system of claim 13, wherein the fabric barrier sleeve comprises woven carbon fiber infused with an elastomeric material.

15. The system of claim 13, wherein the sealing element further comprises a wire reinforcement structure embedded within the sealing element.

16. The system of claim 13, wherein the seal apparatus further comprises a fabric reinforcement layer fused onto one or more outer surfaces of the sealing element.

17. The system of claim 13, wherein the seal apparatus further comprises one or more debris barriers configured to be actuatable to close off a portion of an annulus that is positioned adjacent to the sealing element, the debris barriers configured to be actuated to block debris from entering into the portion of the annulus positioned adjacent to the sealing element.

18. A method comprising:

positioning a seal apparatus comprising a sealing element in an unactuated configuration at a location downhole within a wellbore, the sealing element configured to form a seal between the sealing element and a surface positioned adjacent to the sealing element when the sealing element is actuated into a sealing configuration, the seal apparatus further comprising at least one extrusion limitation assembly positioned at an end of the sealing element, the extrusion limitation assembly configured to limit or eliminate a lateral extrusion of the sealing element while the sealing element is actuated into the sealing configuration, the at least one extrusion limitation assembly having a plurality of radially expandable components that are completely enclosed in a fabric barrier sleeve configured to block debris from coming into contact with the plurality of radially expandable components; and actuating the sealing element by applying a laterally compressive force to the sealing element, the laterally compressive force expanding the sealing element in a radially outward direction to form the seal between a tool body of the seal apparatus and the surface positioned adjacent to the sealing element.

19. The method of claim 18, further comprising:

deactuating the seal apparatus to allow the sealing element to return to the unactuated configuration; and retrieving the seal apparatus from the wellbore.

20. The method of claim 18, wherein the sealing element further comprises a wire reinforcement structure embedded within the sealing element.

21. The method of claim 18, wherein the seal apparatus further comprises a fabric reinforcement layer fused onto one or more outer surfaces of the sealing element.

22. The method of claim 18, wherein the seal apparatus further comprises one or more debris barriers configured to be actuatable to close off a portion of an annulus that is positioned adjacent to the sealing element, the debris barriers configured to be actuated to block debris from entering into the portion of the annulus positioned adjacent to the sealing element.

* * * * *